US008323062B2

(12) United States Patent
Bannasch et al.

(10) Patent No.: US 8,323,062 B2
(45) Date of Patent: Dec. 4, 2012

(54) FLEXIBLE IMPACT BLADE WITH DRIVE DEVICE FOR A FLEXIBLE IMPACT BLADE

(76) Inventors: Rudolf Bannasch, Berlin (DE); Leif Kniese, Berlin (DE)

( * ) Notice: Subject to any disclaimer, the term of this patent is extended or adjusted under 35 U.S.C. 154(b) by 149 days.

(21) Appl. No.: 12/596,638

(22) PCT Filed: Apr. 18, 2008

(86) PCT No.: PCT/EP2008/003318

§ 371 (c)(1),
(2), (4) Date: Jul. 30, 2010

(87) PCT Pub. No.: WO2008/128780

PCT Pub. Date: Oct. 30, 2008

(65) Prior Publication Data

US 2011/0281479 A1 Nov. 17, 2011

(30) Foreign Application Priority Data

Apr. 18, 2007 (DE) ..... 10 2007 019 540

(51) Int. Cl.
*B63H 1/36* (2006.01)

(52) U.S. Cl. ..... 440/15; 114/332; 114/337; 416/81

(58) Field of Classification Search ..... 440/13, 440/14, 15; 244/22, 72; 416/81; 114/332, 114/337

See application file for complete search history.

(56) References Cited

U.S. PATENT DOCUMENTS 6,089,178 A 7/2000 Yamamoto et al.
6,138,604 A * 10/2000 Anderson et al. ..... 440/15
6,250,585 B1 * 6/2001 Pell ..... 244/22
6,974,356 B2 * 12/2005 Hobson et al. ..... 244/22

* cited by examiner

*Primary Examiner* — Lars A Olson
(74) *Attorney, Agent, or Firm* — Mark P. Stone

(57) ABSTRACT

A watercraft having a plurality of flexible section secured to a mount, having a drive assembly, wherein the water craft can move the flexible section upwardly and downwardly to propel the watercraft through the water.

18 Claims, 16 Drawing Sheets

FIG. 1A
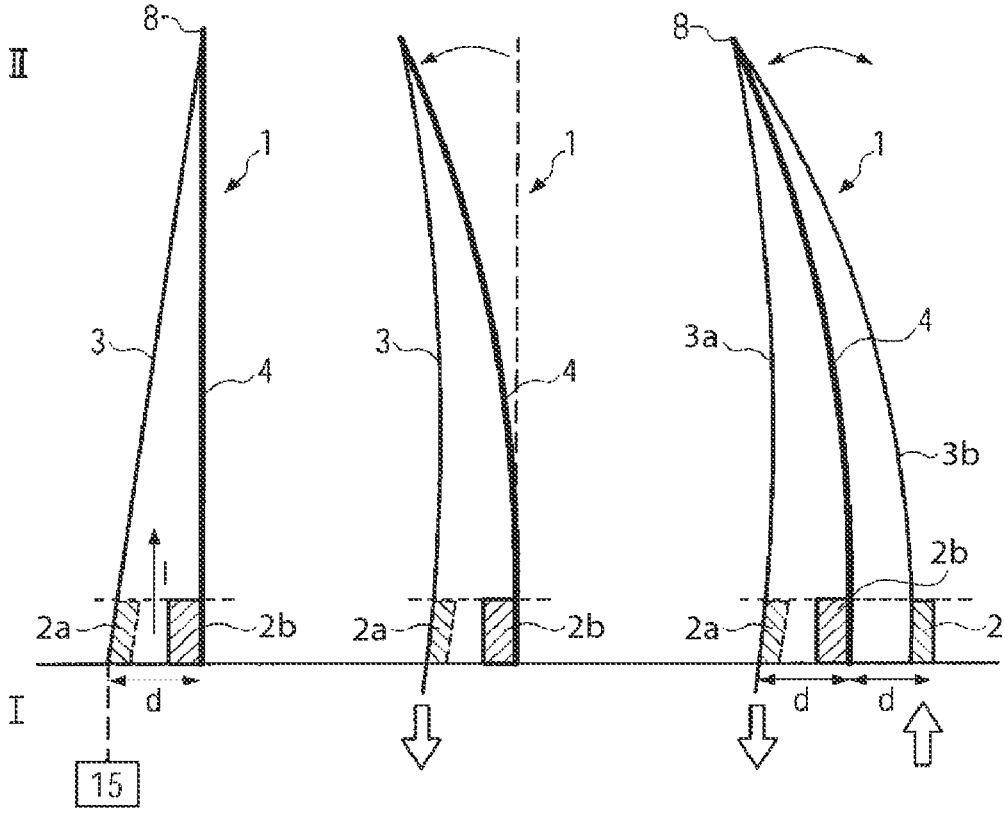
FIG. 1B
FIG. 1C
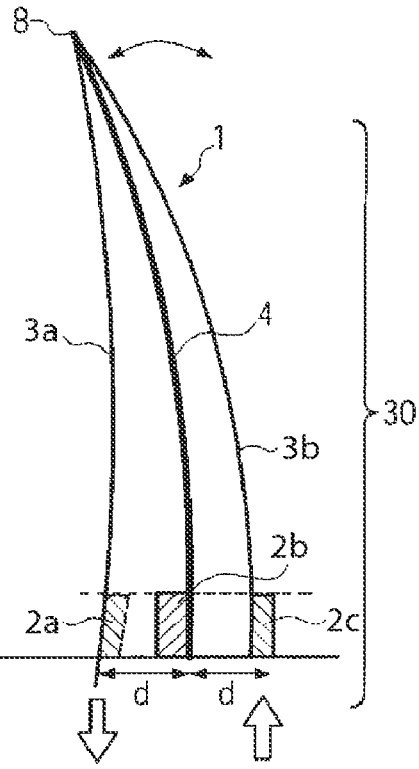
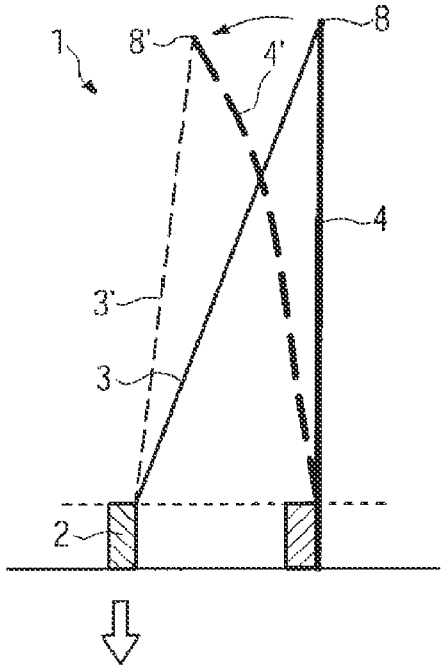
FIG. 1D
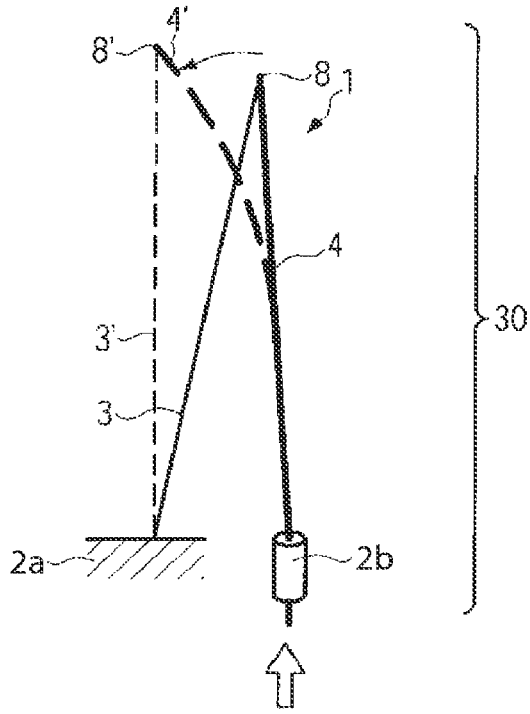
FIG. 1E

FIG. 3A
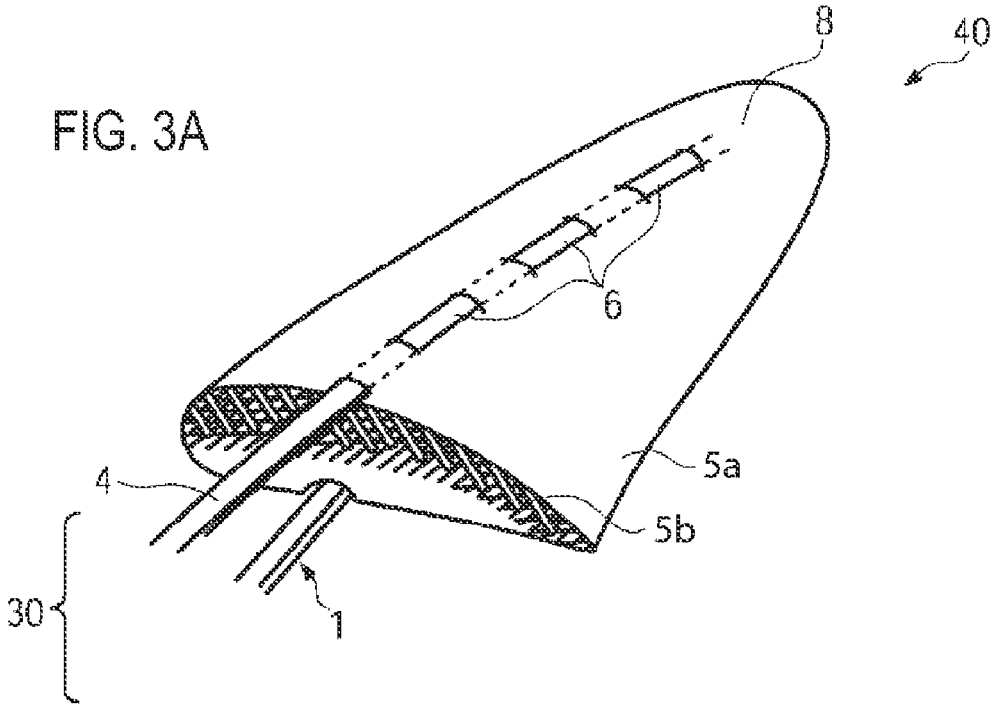
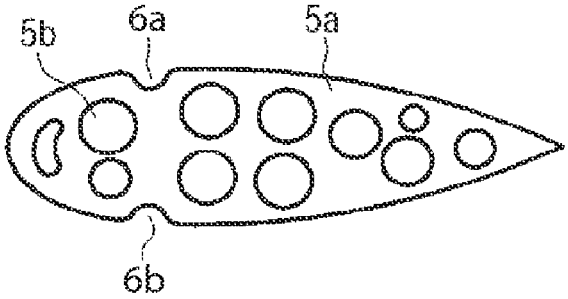
FIG. 3B
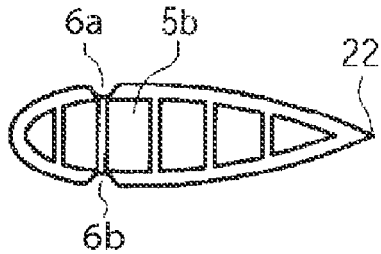
FIG. 3C

FIG. 6A
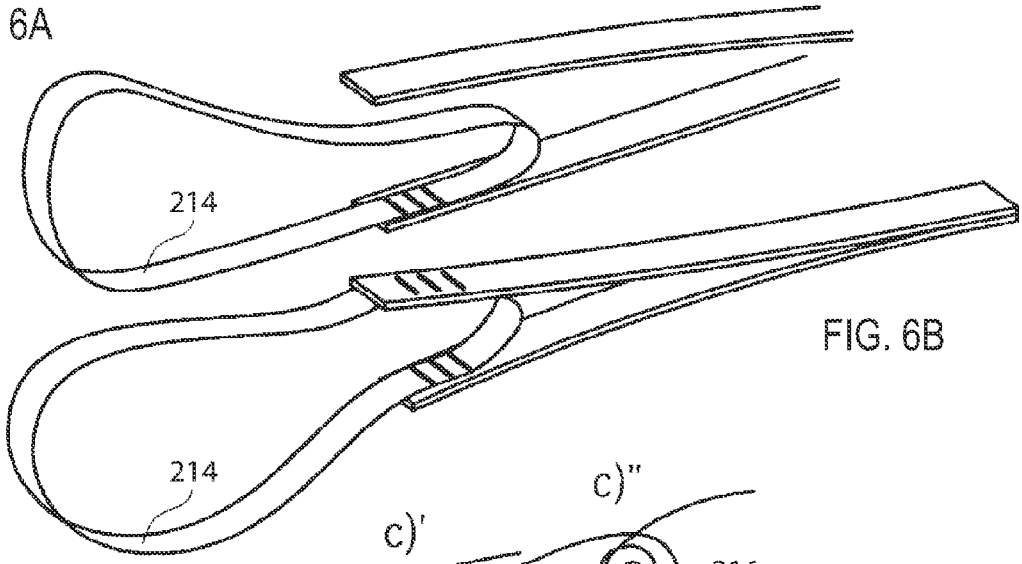
FIG. 6B
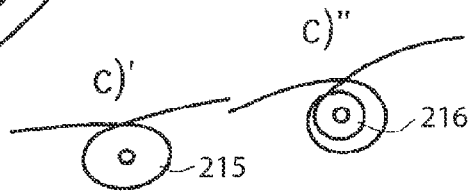
FIG. 6C
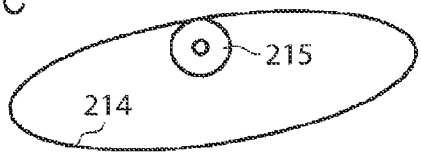
FIG. 6E
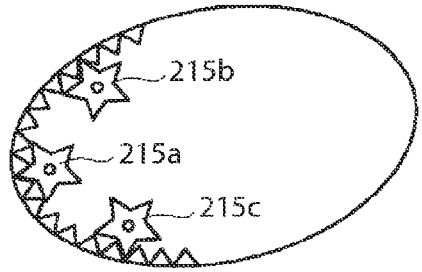
FIG. 6D
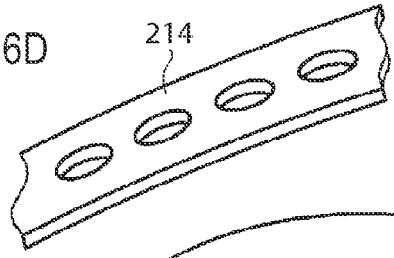
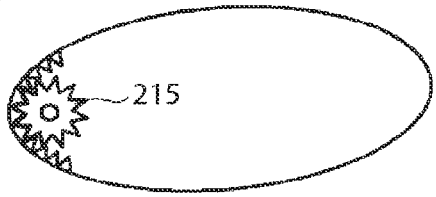
FIG. 6F FIG. 9A
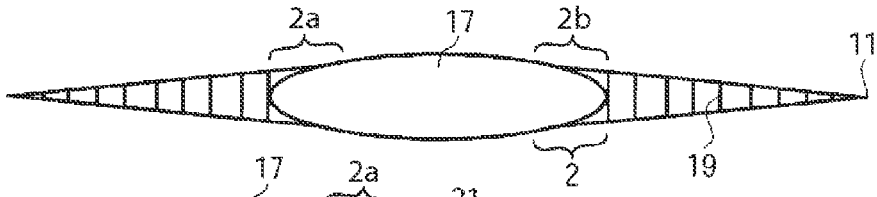
FIG. 9B
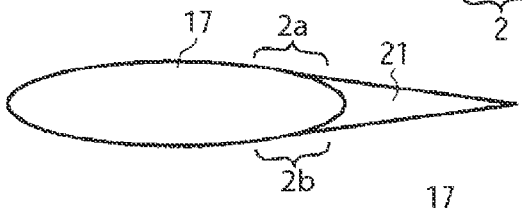
FIG. 9C
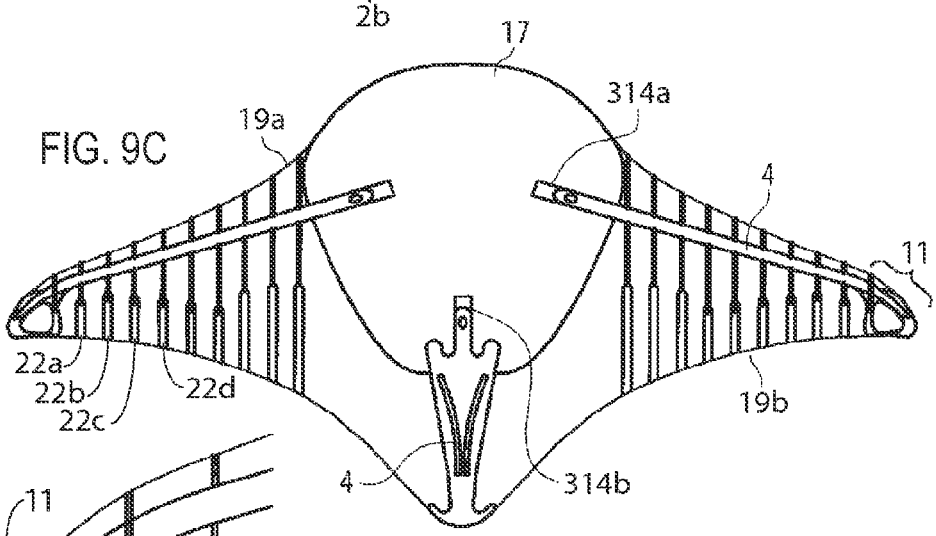
FIG. 9D
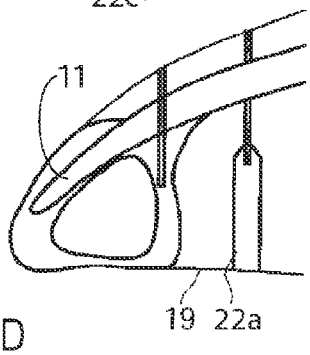
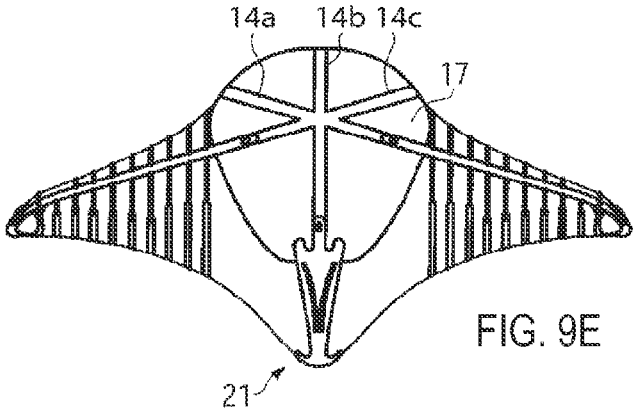
FIG. 9E

FLEXIBLE IMPACT BLADE WITH DRIVE DEVICE FOR A FLEXIBLE IMPACT BLADE

CROSS REFERENCE TO RELATED APPLICATION

The present application claims priority and the benefit of co-pending International Patent Application No. PCT/EP2008/003318 filed on Apr. 18, 2008, entitled "FLEXIBLE IMPACT BLADE AND DRIVE DEVICE FOR A FLEXIBLE IMPACT BLADE", which further claims priority to German Patent Application No. 10 2007 019 540.2 filed on Apr. 18, 2007. These references are incorporated in their entirety herein.

FIELD

The present embodiments generally relate to a device for a flexible impact blade with a drive device and a watercraft with a drive element and/or a control element.

BACKGROUND

A need exists for a flexible impact blade, a flexible impact blade with such a drive device and a watercraft with a drive element and/or a control element.

The drive device for a flexible impact blade is configured on a side such that the same can be connected to a drive, and has a flexible element substantially in the shape of a wedge, said flexible element having at least two flexible sections extending away from the drive that are at a distance to each other on the side of the drive, the distance from each of which is reduced in the direction away from the drive and which are coupled in the region of the end of the flexible element facing away from the drive in a power transmitting manner.

The invention furthermore relates to a flexible impact blade that can elastically and three-dimensionally deform, whereby a continuous change of shape can be adjusted with a flowing contour transition.

In several aspects, the invention was inspired by observations of bird flight and the underwater "flight" of penguins, sea turtles and manta rays, which have interesting flight or swimming characteristics and to some extent extraordinary manoeuvring skills, which have so far evaded replication in this form by the comparably rigid systems normally used in technology.

The invention rises from the wish to create a technical solution that comes closer to the behaviour of paradigms in nature (particularly the manta wings) as far as movement kinematics and flow dynamics are concerned and—without wanting to copy the biology in detail—that can be implemented in the simplest possible way with the means and materials available in technology.

Designs in which remarkable characteristics are achieved in the interaction of flexible composites with the surroundings are known in the state of the art, e.g., under the brand name Fin Ray Effect®, and comprise, e.g., toothbrushes, lever constructions, pliers, swimming flippers, etc. What these have in common with other equally known profile elements for sails and airplane wings is that they passively deform under the effect of an extendal force in a manner that is advantageous for the application in question.

Some designs can be tilted or pivoted around an axis of rotation at the base or can, e.g., in the case of a chair back, also be tensed in a manner that changes the shape.

In AU 6563380 A (MC Kinlay I. B.), a rudder structure is described that is held on an axle and that has an adjustable profile form in the cross-sectional plane.

Additionally known are profile elements, especially for ship's sails (LU 88 528 A., Thirkell Laurent) and aerofoils (EP 0 860 355 A1, Flavio Campanile), with a flexible outer skin and internally placed spacers, that are held to length or laterally curved by a bending-resistant middle part, as well as blade ribs with a closed—and consequently constant-length—bendable outer belt, whose curvature can be varied with respect to the outer belt to a limited extent via an active change of the angle of inclination of internal stiffening elements. In the aforementioned cases, the variation aims at influencing the profile geometry in the flow direction; the blade geometry in the mast or blade span direction is not addressed.

A need has existed for an invention that by simple structural measures, provides an elastically bendable blade as well as a drive device for such a blade, which can deform in a plurality of directions and in which a continuous change of shape with flowing contour transitions can be adjusted, so that this can be used, e.g., in the flow dynamics application for control functions or also for propulsion generation, whereby other application functions are to be made possible with regard to use in the broader sense.

Another need has existed for a combination of two or more blades into a system for generating a cross-fluid force, propulsion and/or lift/buoyancy, for example, into a watercraft according to a type of "bionic flying wing", that can execute complex flight manoeuvres with ray-like manoeuvrability.

A need has existed for a highly flexible blade, and in particular a drive device and the parts of its skeleton, that are as flexible as possible, whereby the parts are connected in a soft and jointed manner, while a high level of structural stability is nevertheless achieved.

The present embodiments meet these needs.

BRIEF DESCRIPTION OF THE DRAWINGS

The detailed description will be better understood in conjunction with the accompanying drawings as follows:

FIGS. 1A through 1E shows a flexible element usable for propulsion;

FIG. 3A is a top sectional view of the blade with guide sleeves and material distribution with chambers.

FIG. 3B is a cross sectional view of the elastic blade with shaped material

FIG. 3C is a cross sectional view of the elastic blade with a material distribution chamber.

FIGS. 6A-6D depict the flexible impact blade with a convex, preferably elliptical, body cross-section using a closed strap loop.

FIGS. 6E and 6F show that a strap loop can partially also be formed as a toothed belt.

FIG. 8A is a frontal view of another embodiment with an actuator and drive wheels and a movable tail wing drawn in.

FIG. 8B is a dorsal view of another embodiment with actuator and drive wheels and a movable tail wing drawn in.

FIG. 9A shows a front view of a wing.

FIG. 9B shows a detail of a wing.

FIG. 9C shows a bottom view of the wings attached to the elliptical body.

FIG. 9D shows an end of the wing attached to the body.

FIG. 9E shows another embodiment of the winged body with and three bendable surface elements in a horizontal arrangement.

Figure 2:
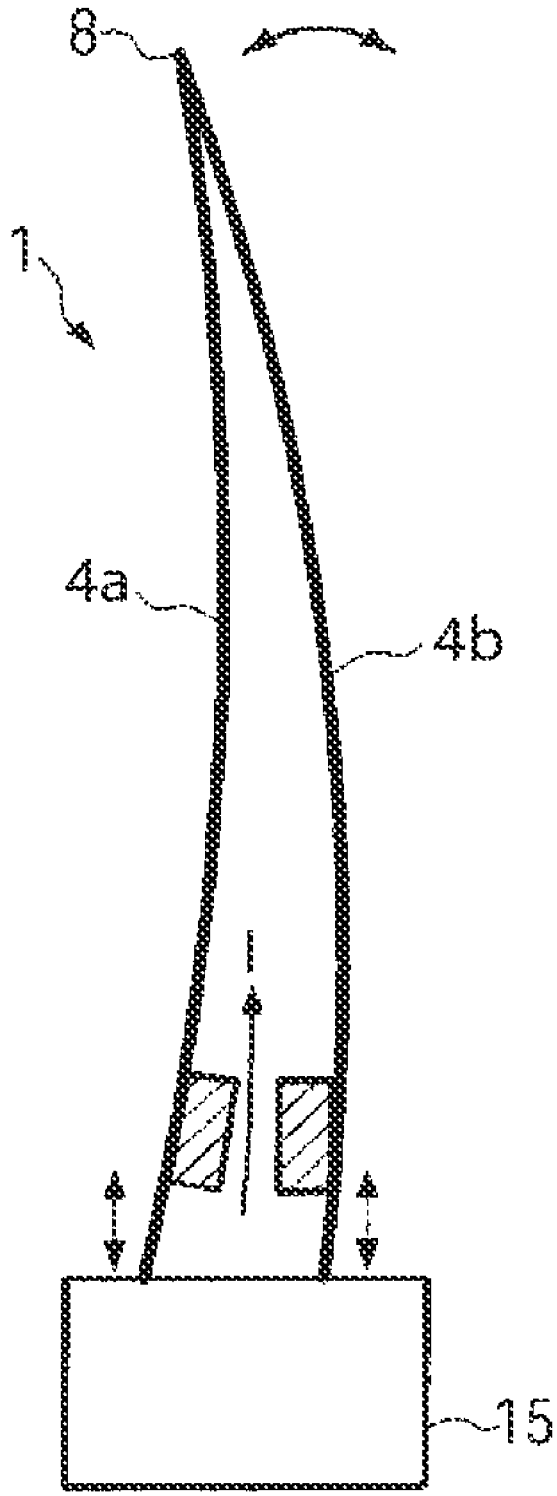
FIG. 2 shows a connection element according to the invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a drive device for a flexible impact blade in that the flexible sections are held movably relative to one another substantially along the longitudinal axis of the wedge on the side of the drive, and in that the flexible element is configured on the side of the drive such that it may be transferred to a different curvature pointing in the direction of thickness of the flexible impact blade, i.e., perpendicular to the cross-section of the flexible element having the shape of a wedge, as a function of the relative position of the flexible sections.

In one or more embodiments, can include a flexible impact blade that, as a support element, has a flexible spar running from a blade base to a blade tip, which is supported at its base in a manner that prevents tilting and rotating and that otherwise functions as a flexible element. The flexible impact blade can also have a connecting element that acts diagonally on the outer area of the flexible element and that is connected to an actuator at the other end, which can allow the flexible element to be curved across the blade surface so that a blade deflection is brought about in the form of a bending vibration with continuous contour development.

In one or more embodiments, the impact blade can be elastically twisted. Furthermore, one or more embodiments of the impact balde can include a spar designed in a torsionally elastic manner.

In one or more embodiments, the connecting element is formed equally as a flexible element and is supported at its base in a manner that prevents tilting and rotation and that allows displacement in the axial direction.

In one or more embodiments, one or more of the flexible impact blades described herein can be connected to one another, such that a spar of one blade is formed with the counterpart of the opposite blade as a continuous flexible spar and the two other spars of the opposite sides can be displaced symmetrically by a shared adjusting element or, by means of separate adjusting elements, also asymmetrically, where appropriate, in their longitudinal direction.

In one or more embodiments, the flexible impact blade can include spars formed as adjusting elements and, mechanically coupled at a base of the flexible impact blade. The spars can be configured to be adjusted in opposite directions by the actuator.

In one or more embodiments, the support elements can have a soft, flexible tip after the point of attack of the connection element, which tip can carry out a movement deviating from the arm, e.g., can be pliably deformed when an outside force is applied, so that in the case of a blade beat, a wave-shaped curve development of the blade contour/S-beat can be achieved, and which, during the generation of lift/buoyancy, also acts as an elastic winglet and contributes to the reduction of the wake turbulence resistance.

In one or more embodiments, the body of the flexible impact blade can include or be made from an elastomer. The body can also have a special sleeve for the spar and/or connection element can be provided.

In one or more embodiments, the body of the flexible impact blade can be built up with profile rib in the manner of a skeleton structure, which profile ribs are aligned in the direction of flow.

In one or more embodiments, the flexible impact blade can include a controllable actuator for attenuating, amplifying or actively effecting a twist of the blade. In one or more embodiments, the actuator can acts on the flexible impact blade. For example, the actuator can allow for active twisting of the flexible impact blade via traction elements, which run in the form of a spiral in or around the support element, at least in one section. In one or more embodiments, the traction elements can be arranged at a predetermined distance from the support element. Furthermore, the traction elements can span at least two profiles spaced apart from each other diagonally in regard to their profile height and shorten the diagonal distance when there is a pulling action so that the profile elements twist relative to one another around the longitudinal axis of the support element and the surface spanned by the profile elements is correspondingly twisted.

In one or more embodiments, the flexible impact blade can include a flexible shaft is present for transmitting a torsional force.

In one or more embodiments, the flexible impact blade can include at least two support elements are present per blade, which support elements are at a distance to one another and can be individually controlled in reference to their deflection so that the blade surface can be twisted in various ways.

In one or more embodiments, the flexible impact blade can include one or more profile elements equipped with a flexible rear edge. The profile elements can be structured in a blade area and can be formable. At least one controllable actuator element can be used to change the shape of profile elements.

In one or more embodiments, the flexible impact blade can include a body segment with a roughly elliptical cross-section in at least one projection, in which each of the spars of the support elements junctions tangentially, or bear on in a form fit way with this so that in the shape transition from supporting structure and variable-form surface element there is a constant progression of the outer contour.

In one or more embodiments, the flexible impact blade can include a loop-like strap attached one or more spars of the support element. The loop-like strap can be connected, either on both ends or as a circular loop, to a motorized element for longitudinal displacement of the spar and can be guided around the body contour in the base area of the support element. For example, the loop-like strap can be guided around the body contour in the base area of the support element in a slideway or via a wheel or a multiple-link roller bearing, so that when the loop-like strap is pulled in one direction or the other, the attachment point of the spar is displaced tangentially along the outer contour of the supporting structure.

In one or more embodiments, the flexible impact blade can include a strap to hold at least one support element on the body. The strap can be connected at both ends or as a circular strap to a motorized element for longitudinal displacement and can form a tangentially loop lying against the body segment on both sides in the base area of the support element, which runs around the body. The strap can be guided there in a slideway or via a wheel or a roller bearing, whereby the two spars of the support element are attached on opposite sides of the loop, so that when the band is pulled in one direction or the other, the two spars are displaced in directions opposite to one another tangentially along the outer contour of the supporting structure.

In one or more embodiments, the flexible impact blade can include a motorized unit or an adjusting element, which can operate a plurality of adjustment functions simultaneously.

In one or more embodiments, the flexible impact blade can include three blades. One of the blades can be formed as a backward tail segment. The flexible impact blade can also include a suitable number of actuators, and the actuators can be arranged in the body.

In one or more embodiments, the flexible impact blade can include an elastically stretchable outer skin, which can enclose or encapsulate at least the blades and the tail segment.

In one or more embodiments, the flexible impact blade can include a means for changing its aero- or hydrostatic lift/buoyancy.

The flexible impact blade according to the invention solves the above object in that at least one of the drive devices according to the invention is provided for changing the outer contour of the flexible impact blade, whereby the drive-side ends of the flexible sections are arranged in the area of the blade root.

The watercraft according to the invention solves this object in that the drive element and/or the control element is a flexible impact blade according to the invention. The term "watercraft" also comprises vehicles that move in other fluids, including gases, and so consequently also aircraft.

To be understood as a flexible section are both traction elements, for example, cables that transmit fraction forces, as well as compression elements that transmit traction and compressive forces, such as compression rods or spars. These flexible sections can also be flat elements, e.g., a flexible plate. To be understood as having the shape of a wedge is a body in which two elements or side surfaces run towards each other in a manner defining an acute angle. In the context of this invention, wedge-shaped can comprise, but does not assume, that the elements that run towards each other also meet in an acute angle.

This object is also solved according to the invention in that a flexible impact blade, e.g., in the flow dynamics sense, a blade, wing or a control element, is equipped with a flexible support element as a flexible section, which runs in the interior of the blade in the blade span direction and functions as a flexible support, which is connected to an actuator that can continuously curve the flexible support across the blade surface.

From this, it follows that, if the flexible support that defines a flexible section in the aforementioned arrangement is curved, the deflection in the blade span direction grows nonlinearly, and always reaches its greatest value at the distal end, i.e., at the blade tip. Such a movement is greatly advantageous for the drive and/or control with, e.g., a blade according to the invention mounted on the stern of a vehicle and/or for propulsion generation with a cyclic beating movement of a blade arranged across the flow, or also for stabilising a flow body, because doing this achieves the greatest effect in the outer area of the blade.

Unlike the procedure that is otherwise generally customary, in which the blade is rotated or pivoted around an articulated axis at the root as a rigid body in order to generate a blade deflection, whereby a high root bending moment arises that must be brought under control by means of a corresponding stiff and solid spar design, and the blade, under the effect of the fluid dynamic forces deforms at best passively, i.e., against the beating direction, a substantial unusual quality of the present invention lies in the fact that the adjusting force is introduced into the structure not at the root and not across the spar, but instead at the tip of the supporting element or roughly in the area of the force focal point of the flow dynamic forces in the outer area of the blade, in order to selectively actuate the outer area of the blade.

The drive device according to the invention, the flexible impact blade according to the invention and the air- and watercraft according to the invention can be further developed by various mutually independent developments, each of which is advantageous in itself. The following is a brief discussion of these developments and the advantages associated with each of the developments.

The power transmission to the outer area of the blade can, according to the invention, take place by means of traction elements or compression rods as flexible sections of the flexible element, which are guided from the proximal end, meaning from the blade root, outwards in the form of a wedge under an acute angle to the side facing away from the driven side, e.g., a tip of the flexible element, where the flexible sections are connected at their ends facing away from the drive in a power-transmitting manner. By means of corresponding actuators of a drive, at least one of the driven-side sections of a flexible section can be operated, whereby traction elements, cables, etc., are, as a rule, slimmer and lighter than compression rods, and are to be preferred as a rule, in view of light-weight construction and also for various other reasons. Because the adjusting force depends on the angle of attack which, in the case of a flexible impact blade, is restricted by the profile height at the root of the blade, if there is a central arrangement of the support elements, i.e., the supporting flexible sections, it is also possible to use only half the profile or blade height as the base distance, i.e., the driven-side distance between two coupled flexible sections. If the base distance is large, the traction force is correspondingly larger and the adjustment travel is simultaneously smaller. It is to be decided which embodiment is the most suitable depending on the application, specifications and influencing factors, including: strength of the acting forces or forces to be applied, length-thickness ratio of the blade to be moved, actuator principle, sensor requirements and other framework conditions.

In the case of an application of force on one side or an application situation in which the blade must be actively moved only in one beating direction, the following, e.g., presents itself: moving at least one flexible section of the flexible element as far as possible on the outer contour of the blade, and preferably bringing about the curvature by means of one or more traction elements, which are arranged as far as possible in the vicinity or in the opposing outer contour. This reduces the greatest possible base distance. In case of force conditions that exist on both sides or that are symmetrical in both movement directions, a flexible section that is stable under pressure can be coupled to a further flexible section that is stable under pressure for force transmission.

In general, it is pointed out that when the available installation space is used for arranging the belts as far as possible in the outer area and there is a correspondingly large base distance, the geometrical moment of inertia and consequently the structural stability of the blade is increased.

In this way, a section of at least one flexible section can be held at the drive-side end in a bearing in a way that prevents tilting. A way that prevents tilting means that the held section cannot be tilted relative to the bearing. A rotational movement around the longitudinal axis of the held section and axial displacement along the longitudinal axis are admissible and even desired in some embodiments. In other embodiments, the held section can also be fixed in place in the bearing.

In this way, the invention can additionally provide a bearing that in the most general sense means a component of any kind whatsoever on which the drive device according to the invention or the drive-side flexible sections of the blade according to the invention can be attached, held or run, e.g., a plate, an open frame structure, a clamping element or a closed casing or skin, a body segment, etc., and where appropriate, even another blade. Consequently, the flexible element according to the invention of the blade according to the invention, or its drive device, is run in the drive-side base area, i.e., at its root, in a predetermined alignment in a way that prevents tilting with reference to the holder, although this does not mean that it can pivot around a pivot joint. For the sake of completeness, it is mentioned that the component used for the bearing can then in turn be movably supported in a form known from the state of the art, and altogether diverse combination options result with known designs, although this subject is not gone into in more detail here.

In the following, the description substantially investigates an advantageous embodiment for blades with relatively slim profiles, which are loadable on both sides and which can be actuated on both sides with a low expenditure of energy with a continuous contour development.

In the aforementioned advantageous embodiment, the flexible support that serves as a flexible section is arranged at the upper or lower profile edge and is preferably held in its base area in a suitable holder on the body in such a way that its upper edge passes into the body contour roughly tangentially. On the opposite profile edge, i.e., the corresponding lower or upper one, a flexible compression bar is inserted as a further flexible section, which is connected to the flexible support in the outer area of the blade at an acute angle and that has, in the projection onto the middle plane of the blade, the same alignment as the abovementioned flexible support and that is connected to the same at the desired point of attack in a non-positive manner and is guided in its base area on the relevant body side in a corresponding holder in such a manner that it can slide, so that it can be displaced along its longitudinal direction. An actuator is provided for the axial displacement, which actuator meshes in the base area or at least near to the same or on the end of the compression bar directly or by means of a suitable mechanical connection. Because the blade is to be deflected in both directions, the compression bar acts in the opposite direction as a traction element, whereby (action equals reaction) it is clear that the flexible bar is also loaded in its longitudinal direction, alternating between traction and compression. From the symmetry condition, it follows that the flexible support and the compression or traction bar can also be identically designed as flexible sections in the blade area, as a result of which they are generally referred to as "spars" or "belts" in the following. As a result it is made clear that the belts or spars can, where appropriate, also be flexible flat elements, composites or functional units that are composed of a plurality of structural components or fibre elements arranged side by side, which, in regard to their individual design and fibre alignment, can display finer differentiations or can, where appropriate, also be designed to be individually exchangeable, whereby, e.g., a variable adaptation to various usage conditions is made possible, and service and repair are made easier. Apart from the alternating signs of the stress direction in the progression direction of the spars or belts during the load change as a fraction or compressive stress, the mechanical characteristics and particularly also the bending characteristics of the flexible support or the flexible impact blade altogether are always determined in interaction with the mechanical characteristics and the geometric arrangement of all sub-components seen as a whole. In the case of the design according to the invention, the blade support contains two physically, or at least functionally, differentiable structural elements, which can be variably activated or actuated individually or in combination in a manner that is suitable/according to the invention. In other words: both spars together form the flexible element of a preferred embodiment of the structure according to the invention.

The curvature or bending movement of the blade is brought about in the arrangement according to the invention in that the two spars are axially displaced relative to each other in their base area. This implies two possibilities. Consequently, e.g., one spar can be fixed in place at its root, while the other is supported in a manner that allows it to move. It is likewise possible for both spars to be movable, i.e., to be supported in a manner that allows displacement in the axial direction. The guidance can be brought about on one side, e.g., inside or outside, front or back, for example, in a guide groove, sliding rail or the like or in a sleeve, where appropriate, also with ball or roller bearings or also freely suspended, i.e., without direct solid-body contact, for example, via a suitable alignment or tensioning of fraction elements, which can be advantageously coupled to the actuator system.

The bend curve, i.e., the bend progression of a bent flexible section, can be advantageously influenced by structural measures (material distribution, geometry, etc.) and/or by operative measures.

According to a further advantageous embodiment, the flexible element can substantially be developed in the shape of a pyramid-shaped wedge and have at least three flexible sections, at a distance to one another on the drive side, whose distance from one another is reduced in the direction away from the drive. In this arrangement, the flexible element can not only be bent in a bending plane, it can also be curved in a further spatial axis, i.e., even out of the bending plane, by means of correspondingly actuated relative movements of the drive-side flexible sections of the flexible element. The end of the flexible element facing away from the drive can consequently be bent into intersecting curvature planes, as a result of which circular bending movements, for example, can be achieved.

Two rod-shaped flexible sections, which are formed as a wedge, can only be curved in the bending plane, which is spanned by the longitudinal axes of the wedge. If one now couples a further flexible section to the tip of this wedge, said flexible section being at a distance from this bending plane at the side of the drive, the originally V-shaped flexible wedge can be curved out of its bending plane if a traction or compressive force is exerted at the tip of the wedge via the third flexible section.

Alternatively, the flexible element can also have four flexible sections, which form a wedge in the shape of a pyramid with a rectangular base.

In a further advantageous development, the end of the flexible element that faces away from the drive can continue in the direction away from the drive as a flexible extension or finlet.

In this way, it is possible to achieve movement kinematics of the flexible element or of the flexible impact blade, that the flexible element drives, that have a natural appearance. For example, this can be achieved by having the connection point of the flexible elements, e.g., two bendable spars, lie roughly ⅔ to ⅘ of the maximum distance of the maximum length of the flexible element, as a result of which the flexible element continues from the connection point as a flexible extension to the blade tip in a manner that is altogether softer, i.e., more bendable and more easily twistable, so that an "arm area" and a "hand area" can be distinguished, which have different characteristics and which differ in their motion kinetics and in their flow dynamics behavior to the extent that the hand area elastically follows each up and down beat and, when seen from the front, is curved in the opposite direction of the arm area. Consequently, the interaction with the fluid results in an overlapping bending vibration or, during the beating cycle, in a wave movement, without any additional actuating elements being necessary. Moreover, the S-beat results in an improvement in the flow behavior at the tip and, particularly if there is an arrangement as a tail, in the breakaway behavior of the flow at the rear edge. A soft blade tip is furthermore more shatterproof and can also not cause any damage externally in the event of a collision.

In a further variant, the hand area can also be arranged for its part as a smaller flexible impact blade or it can serve as a drive device for the same, which can be separately activated so that more complex motion sequences or selective control functions and manoeuvres can be implemented in the interaction of arm and hand blades, and the flow behaviour, including the formation of wake turbulence, can be actively controlled or influenced in the same manner as for a controllable winglet.

A further important degree of freedom in the motion can be achieved in that the blade can be elastically twisted in the blade span direction. This is particularly important for generating the propelling force. In this connection, it is helpful that, in a preferred embodiment, the flexible element is itself also formed to be torsionally elastic. The torsional properties can be stipulated or selected by means of the material and structural design of the flexible section or sections, and can be influenced within certain limits by the structural stress, variously strong traction forces or even by a variable internal pressure in the flexible sections.

The torsion itself can come about passively, e.g., by means of asymmetrical action of external forces on the front and rear blade area, or, on the other hand, however, it can also be brought about actively, for example, for steering and navigating. By means of a controllable actuator, the torsional stiffness of the blade can be easily changed, and attenuation, amplification or active effecting of a twisting of the blade can be achieved.

According to the invention, the blade twisting can be actively controlled in a very wide range of ways. For example, the drive device according to the invention can have traction elements which, at least in a section, run in the form of a spiral in or at least around a flexible section. Alternatively, at a distance from the flexible impact blade, two profiles spaced apart from each other in regard to their profile height can be tensed diagonally and can shorten the diagonal distance when there is a pulling action, so that the profile elements twist relative to one another around the longitudinal axis of the actuator arm and the surface spanned by the profile elements is correspondingly twisted.

In another preferred embodiment, the transmission of a torsional force can be achieved by means of a flexible shaft.

On the other hand, in certain applications it can be advantageous if two or even more drive devices are present per blade, said devices being spaced apart from one another and having a movable connection to profile elements that define the outer contour of the blade, whereby the support elements can be individually activated in reference to their vertical deflection. In this way, the front and rear flexible elements can be curved to different degrees and consequently the blade surface can be twisted in a different manner. With two or more supporting flexible elements, it is also possible to implement more complex kinetic sequences, such as an undulating motion.

In an especially advantageous manner, a combined bending and torsional motion can be achieved in that at least one flexible section extends at least in sections substantially in a screw shape from the drive-side end of the flexible element to the end of the flexible element facing away from the drive.

It is also mentioned that by means of a controllable lateral twisting of a flexible impact blade according to the invention arranged in the tail area of a watercraft, a combined aileron and elevator effect can be achieved, whose advantages are sufficiently know from bird flight.

An S-stroke and, where appropriate, improved downstream behaviour can also additionally be achieved in the profile direction, i.e., from the driving end to the rear end, by means of, e.g., equipping profile elements that are arranged on the rear end of the blade with a flexible rear edge. Flexible rear edges are also suitable, e.g., in order to allow the uniform constant 3D deformation of the entire surface, which is deformable in many ways, in a manta-ray-like design with two triangular-shaped blades and one tail, as well as an elastic skin spanning the entire structure (bionic flying wing).

In a further advantageous embodiment, a drive, which can be connected to the drive-side end of at least one flexible section in a manner that transmits motion, can be present, by means of which a drive component aimed at the end of the flexible element facing away from the drive can be introduced into the flexible section during operation.

The application of force for axial displacement substantially along the longitudinal axis of the wedge of one or more flexible sections, e.g., spars, in the root area can, according to the invention, take place in various ways, for example, by means of corresponding lever structures or other means for motion conversion or also directly by means of linear drive: e.g., linear motors, hydraulic or pneumatic functional elements, artificial muscles, etc., that can, where appropriate, also function at the same time as guiding or holding elements. Here again the state of the art offers diverse design possibilities and ongoing enhancements that can be addressed here only by way of example, but that can equally be incorporated into the invention.

By way of example, an advantageous embodiment of the drive is explained in somewhat greater detail, in which embodiment the connection or force transmission takes place via traction ropes, belts, bands or transmission belts that are connected to a suitable actuator.

An advantageous force transmission results in this case particularly if these traction elements act in an axial alignment or as tangentially as possible on the flexible section in question, whereby longitudinal displacement can result from the traction in the distal or proximal direction or can also alternate between the two directions. The connection to the flexible section can be implemented, e.g., by means of suitable joining techniques in a form-locking, substance-to-substance and/or force-fit manner. On the other hand, similar to when biological objects such as bones and tendons are connected to one another, the traction elements can also originate from the spar in question as a flexible section laterally or in an axial extension, e.g., in the form of flexible fibres, that then can be bundled, plaited, woven, and/or, where needed, also surrounded by a protective casing in an appropriate manner. Traction ropes can be used as a space- and weight-saving method for transmitting the motion forces even over larger distances, and, e.g., via rolls, guiding channels, Bowden cables, etc., for guiding them in the desired direction, so that the associated actuator can be arranged at practically any location, for example in the body or in the blade itself, and the remaining constructed space is not blocked by the mechanical transmission elements. At the same time, maximum mobility of the overall structure can also be guaranteed. In further imitation of biology, the fibres can naturally also be connected to an artificial muscle element in the manner of fascia, whereby the actuator principle of the artificial muscle element is based, e.g., on a change in length or volume.

In addition to their adjusting function, the power-transmitting elements can also advantageously be used for attaching a blade to, for example, a support or body segment.

In particular, the drive can have at least one reversible power transmission element, which connects at least two flexible sections to one another on the side of the drive. This embodiment comprises, e.g., that at least one spar, as an example of a flexible section, is attached with a loop-shaped pull cable that is connected to a motor element for longitudinal displacement of the spar on both ends or as a circular loop, and that is conducted in the drive-side base area of the flexible element around a suitable holder or the body contour—preferably in a slideway or via a wheel or a multiple link roller bearing—so that when the loop-like pull cable is pulled in one direction or the other, the mounting point of the spar is displaced, e.g., tangentially along the outer contour of the supporting structure.

Because transverse forces also arise with each traction and compression load and corresponding bending movement, a suitable measure is provided, according to the invention, that prevents the spars or belts from loosening from the blade body/profile body.

This can be achieved according to the invention by means of providing at least one form stabilizer which limits the maximum distance between two flexible sections on at least one point of the flexible element.

When the actuator force acts, the compression bar curves convexly outwards, while the traction belt is tightened, i.e., it is pulled in a straight line. The object of maintaining the distance between the flexible sections and consequently the profile height distribution of the blade in the predetermined shape can be solved in various ways. This can take place, e.g., by means of a skin formed in the outer contour area or lying on the outside, which is held together at appropriate points in a suitable way, by means of clip elements lying on the outside or inside, by means of circular contour bands, by means of special guide sleeves on or in the profile body or by means of an attachment to profile ribs or other spacers, which connect the spars directly or indirectly without preventing the relative longitudinal displacement of the spars with respect to one another.

In particular, connecting elements can be provided whereby each holds two points of the flexible sections at the same distance from each other, regardless of the deformation of the flexible element.

At the same time, it is helpful to know that actually only traction forces have to be transmitted between flexible sections when there is a normal load, which accommodates light-weight construction. It is consequently possible, e.g., to surround spars with a simple 3D braid or to laminate such a braid into the flexible sections, whereby the braid contains a number of cross-fibres/weft threads in an interspace. By means of an appropriate number and suitable arrangement of the connection elements, it is additionally possible to prevent undesired local deformation, so-called buckling, or, in the extreme case, even the breaking of the compression rod, and to guide the force flow within the structure in such a way that shear forces can be avoided and the flexible bar is only loaded with compression forces in its interior, so that it can be kept accordingly slim, which benefits both light-weight construction and the structural elasticity.

Furthermore, according to a further embodiment of the flexible impact blade, this can advantageously have a flexible outer casing or skin in which the at least one flexible element and at least one shaping element that is connected to the flexible element and that defines the flow profile of the flexible impact blade are arranged.

Alternatively, a plurality of profile bodies that are at a distance to one another can be provided that are substantially arranged along a flexible section. In this way, the profile bodies arranged on the flexible section form the skeleton, which defines the flow profile of the flexible impact blade.

Particular advantageously, the profile bodies can simultaneously represent the form stabilizers of the drive device. In this way, the profile bodies not only define the flow profile of the flexible impact blade, they also simultaneously ensure that the distance between flexible sections is limited.

In this connection, it should explicitly be mentioned that the blade according to the invention or profile bodies or parts thereof can be built up in the widest range of ways and with the widest range of materials, for example, in an open skeleton construction with partial, one-sided or two-sided skin or outer covering, as hollow bodies or also as solid bodies, which consist, for example, of a rubber-like material, elastomer, elastic foam, etc., or which can also be structured in the interior in a suitable manner. The state of art continually supplies new possibilities in this direction. In this connection, e.g., the 3D weaving and knitting methods, gluing and joining technologies, gradient and composite materials, laminates and composites, multi-component injection moulding method, etc., are mentioned that allow a wealth of different design variants which can be addressed here only by way of example using a few examples/embodiments.

In the case of a skeleton construction generally preferred in the technology, three dimensional deformation is made simple if the blade is configured in such a way that all structural elements are movable and elastically connected to one another in the joints. For this purpose, the profile ribs can also be completely or partially embedded in an elastomer or can be made of such an elastomer.

A preferred arrangement that allows great mobility and simultaneously good shape stability consists, e.g., of a torsionally elastic profile element or a number of profile ribs attached on the support element at a predetermined angular range such that they can be tilted laterally, that preferably are aligned in the direction of flow and are preferably attached to the spars in such a way that they are movable on both sides. At the same time, attachment of the profile ribs to the support element can also have two or more degrees of freedom where appropriate, so that the profile ribs, e.g., are supported in such a way that they can tilt laterally and additionally can be rotated around the centre axis of the support element across a stipulated range of angles. This simplifies a twist of the blade and reduces the torsional load on the spars. At the same time, it is also advantageous that the ribs that are suspended in such a manner that they can move can be spread like a fan without any expenditure of energy or can be brought together with their free ends and so practically no resistance opposes the changes in length associated with the 3D deformation of the blade surface, particularly in the area of the blade rear edge on the side of the skeleton.

Naturally it is advantageous, particularly in the case of a skeleton construction, if the construction is partially or completely overdrawn or encompassed by an elastically stretchable outer casing, for example, a covering with a type of net, a membrane or generally skin, which two-dimensionally connects and elastically couples the parts so that practically no additional tensioning elements are needed. An elastic skin to some extent ensures "coordinated" behaviour among the moving parts and always provides flowing contour transitions when the geometries change. In addition, it naturally also fulfils a flow-dynamics function, and last but not least also a decorative one, with diverse development possibilities as a sensor or other functional surface, advertising medium.

It is also noted that corresponding sensors and, where appropriate, also collectively a control unit, can be provided in each motion chain.

In a similar way, the blade surface of a flexible impact blade arranged in the tail area can also be changed by being actively or passively spread or folded together, which can, for example, be advantageous for trimming or steering. This degree of freedom can also be further expanded to the effect that the profile elements can be suspended on the flexible sections in the blade plane so that they can pivot freely in the lateral direction, so that the blade surface can, where appropriate, also be completely or partially folded together in the spar direction in the form of a venetian blind or ship in a bottle. By unlocking the shoulder joint or by means of a corresponding support of the blade holder or an additional joint, e.g., in the root area of the spars, it is also possible to position the blade on the body if needed, for example, in order to facilitate transport, to slide the structure through a narrow pressure lock or to launch it like an arrow and then later unfold the wings. Additional advantageous mechanisms for folding, closing and rolling are explained later using the figures.

In order for the diverse individual elements with their very wide range of degrees of freedom to interact optimally, they can be held together, e.g., by springs or rubber-like elastomers, whereby the latter can be formed for example as a circular band. This can additionally also serve to stipulate or change the desired wing sweep.

A spring-elastic coupling of the structural elements can also be achieved in the simplest way by forming a suitable skin structure or by covering them with an elastic net or an elastically stretchable membrane.

The profile ribs can also for their part be shaped differently according to the requirements of the respective application. The possibilities range from solid to thin clips, from full to hollow. They can be, e.g., inflatable or formed as ballonets, buoyancy devices, tanks or other payload carriers, and also can be used for attaching or integrating sensors or other functional elements. For example, profile-forming surface elements can also be formed as electronic printed circuit boards, allowing multifunctional use. The profile elements themselves can also be formed according to the manner of the drive device according to the invention, as a result of which their profile can be actively varied and adjusted.

The possibility for filling profile chambers or other hollow spaces in the blade structure created in an appropriate manner with various media, gases, fluids, foams or solid particles (lead or the like), etc., which differ in their density, compressibility and other characteristics, can, in addition to the mentioned uses for trimming the weight, providing static lift/buoyancy and a downward force, or balancing the structure, also be used for adjustment or active regulation of mechanical characteristics, stiffness, elasticity, restoring forces, etc. At the same time, it is advantageous that the chambers can additionally be individually or, in a suitable composite system, variably acted upon by pressure, for the purpose of which suitable system components (filling nozzles, valves, hoses, etc.) can be integrated in a simple way. By means of using pressurized chambers or membrane structures, it is possible to eliminate solid structural elements and to achieve a high level of strength with a low weight. In addition, e.g., in the case of underwater blades, it is also possible to reduce the transport weight in air by emptying the ballast chambers.

A further advantageous arrangement includes that the flexible sections of the flexible element are also filled with a medium, so that they can be stiffened by means of variable internal pressure, or they can be adapted for various force conditions and/or usage requirements in a simple way. Consequently, the bending behaviour, i.e., its stiffness, can be influenced by means of the pressure conditions in the interior of a flexible section. By means of influencing the stiffness of the flexible sections or of partial areas of a flexible section in the area that bends, it is possible to selectively manipulate the bent form of this flexible section. In this way, it is also possible to achieve complex bends with various radii of curvature. The stiffness of the flexible section can be achieved passively by means of design measures, such as thickness distribution, profiling, gradients or sections with material increments. One can furthermore also change and control the stiffness actively, by sections or across the entire length of the flexible section, by changing physical parameters, such as pressure or temperature, that influence the stiffness. Consequently, a number of pressure chambers can be arranged along the longitudinal axes in the interior of a flexible section, whereby these chambers can be acted upon with a changeable pressure, either individually or in a coupled manner.

For the sake of completeness, it is mentioned again that the interspaces between the structural elements in the blades can also be used in different ways (payload, etc.) and/or they can be filled with a special fluid or simply only with the ambient medium in a way that allows the pressure to be varied, which also further improves the visual or acoustic transparency, among other factors, in addition to the other aspects mentioned.

In a further advantageous embodiment, it is provided that blade parts or the structure as a whole is designed in a membrane-like way and structured in such a way that they or it can be inflated by dynamic pressure (air, or water)

Another alternative also comprises manufacturing blade parts or the structure as a whole from elastomers, whereby, e.g., different material thicknesses and/or material combinations with various characteristics: density, stretching and flexing characteristics, coefficients of elasticity, Shore hardness, etc., can be used for setting up and differentiating the structures according to the invention and the desired functional features. Such a basic setup with integrated compression and flexible elements, cords and "collagen" fibres, integral hinges, hollow spaces, filling elements and differentiated skin structures can, to a large extent or even completely, be manufactured, e.g., in multi-component injection moulding, whereby it is conceivable to create the blade structure in the broader sense also as structured matrix bodies in which other mechanical elements, prefabricated components or even other functional groups, such as certain electronic modules, sensors, etc., can be embedded, for example, by being cast in, or they can also be added later. The above-mentioned possibilities for filling the chamber to variable pressures with various media as well as for holding a payload naturally remain in this integrated or embedded design.

In a further form of an embodiment, shape-changing ribs are provided as a profile element, whereby the ribs' profile curvature can be adjusted in the flow direction by means of an actuator. To give only one example, these can, like the double blades described at the beginning, be equipped on one side with a continuous spar or clip element, which connects the profile nose lying in the direction of flow in front of the blade spar with the profile end lying behind this, and can be curved upwards or downwards relative to one another in the desired way by means of actuation, i.e., axial displacement of corresponding sub-elements on the opposite profile side. By means of the changing profile curvature, the lift/buoyancy or propulsion effects of the blade can be selectively influenced, and it is also possible to implement steering functions. There are, however, still many other implementation possibilities which equally affect the adjusting elements matching these.

In an embodiment of the watercraft according to the invention, at least two flexible impact blades can be arranged opposite one another on a body. Alternatively, opposing flexible impact blades can also be directly connected with their blade roots, while leaving out the body. In this way, one obtains a watercraft that can be complexly manoeuvred by corresponding control of the beating movement of the individual flexible impact blades in the water.

In a further advantageous embodiment of the watercraft, at least one flexible section of the one flexible impact blade can be connected in a movement-transmitting way to the flexible section of the other flexible impact blade. For this purpose, with respect to fixing a spar in place for attachment to a separate support or body segment, in an embodiment with, e.g., two opposing impact blades, a spar of the one blade can also be formed so that it is connected to the counterpart of the opposite blade, for example, whereby the two other spars of the opposite sides can be displaced in their longitudinal direction, for example, symmetrically by a common adjusting element or, by means of separate adjusting elements, where appropriate, also asymmetrically. In this case, the body segment can be freely designed with respect to the size, shape and structure, or can even be left out entirely, which results in different design possibilities, also including for flying wings.

Finally, in a further advantageous embodiment of the watercraft according to the invention, at least one flexible section of the one flexible impact blade and at least one flexible section of the other flexible impact blade can be connected to one and the same drive. In this way, the path length of the longitudinal adjustment and the one-sided stretching or compression of the contour, skin, or material located in the interior associated with this can be reduced and equally distributed on both sides, and the symmetry of the motion can be improved. For this purpose, both spars of a blade are supported in the base area in a manner that allows them to be displaced, and they are preferably moved in a mechanically coupled manner by means of a common actuator.

This can be implemented in an embodiment according to the invention, e.g., in such a way that the support element is held on the body with a pull cable, which is connected to both ends or as a circular pull cable to a motorized element for longitudinal displacement and which forms, in the base area of the support element, a loop lying tangentially on both sides of the body segment, whereby this loop runs around the body and is guided there preferably in a slideway or via a wheel or a roller bearing, in order to minimize friction, whereby the two spars of the support element are attached on opposite sides of the loop, so that when the band is pulled in one direction or the other, the two spars are displaced tangentially along the outer contour of the supporting structure in opposite directions.

By guiding the pull cable around the body, particularly in the form of a ring-shaped, closed loop, and the saddle-like supporting surface, there results a high level of traction and compression stability and robustness against impacts and other mechanical shock effects. The assembly and disassembly of the blade are additionally simplified. Alternatively to this, the guiding of the spars and adjustment elements can naturally also take place on the interior of the outer contour or via an internal skeleton.

The drive devices according to the invention can also be used for a multitude of other applications. They can be used in actively driven or passively flow-operated flow bodies, for example, in flow-dynamic resistance bodies, flow bodies, flow guide bodies, cross-bodies or drive bodies, as stabilizers, wings, blades, sails, kites, etc., whereby the aforementioned applications can also be used in order to extract energy from a flow.

In the following, the invention is explained by way of example, with reference to the accompanying drawings. The various features and characteristics can be combined or left out independently of one another, as was already explained in the individual advantageous developments above.

FIGS. 1A through 1E show a flexible element usable for propulsion.

FIGS. 1A-1E show the basic principle of the drive device 30 according to the invention for a flexible impact blade 40 shown in a different figure. FIG. 1*a* shows the drive device 30 can be connected to a drive 15 on one side.

FIGS. 1A-1E show the drive device 30 comprises a flexible element 1, substantially formed in the shape of a wedge, with two flexible sections a first flexible section 3, a second flexible section 4 that are at a "distance d" to each other on the side of the drive. The "distance d" is defined on the side of the drive by mounting elements 2*abc*. The mounting elements can be a holder, guide, slide bearing or a sleeve, for example. The "distance a" between the first and second flexible sections 3, 4 is reduced in the direction away from the drive, that is, in the direction of the longitudinal axis L of the wedge shaped wing shown in a later figure, which extends from its base in the direction of the tip.

In the area of the "end II" of the flexible element 1 that faces away from the drive, in FIG. 1 of the wedge tip 8, the first and second flexible sections 3, 4 are coupled in a power-transmitting manner.

For example, the first and second flexible sections 3, 4 can be connected to each other in a form-locking, force-fit and/or substance-to-substance manner. The flexible sections can, however, also be coupled in a power-transmitting manner via intermediate elements, as long as the wedge shape with the narrowing flanks of the flexible sections 3, 4 in the direction away from the drive is given.

According to the invention, the flexible sections 3, 4 are held in a manner that allows movement relative to each other on the side of the drive, substantially along the longitudinal axis L of the wedge. For this purpose, the flexible element 1 is able to be transferred into a different curvature pointing in the direction of thickness of the flexible impact blade as a function of the relative position of the flexible sections on the side of the drive. In FIGS. 1A-1E, the direction of thickness of the flexible impact blade corresponds to the straight line that runs through the two bearings 2.

The use of the "prime" indicators on the elements, indicate the direction of movement of the wing in these figures.

In FIGS. 1A-1E, the mounting elements 2 can be bearings are shown as tilt-resistant bearings, which can allow a rotation of the first and second flexible elements 3, 4 around their longitudinal axis as well as an axial displacement of the flexible sections 3, 4, but that prevent tilting of the flexible sections 3, 4 with respect to the mounting element 2. In this way, it is guaranteed that a pressure acting on the wedge tip 8 of the wedge with a force component lateral to the longitudinal axis of a flexible section 3, 4 is converted into a curvature of the corresponding flexible section 3, 4.

In FIGS. 1A-1D depicts the flexible section 4, which indicates a flexible element, such as a compression bar or spar, that transmits traction and compressive forces, is fixed in place in its mounting element 2. I.e., the flexible section 4 is securely held in the mounting elements which in this Figure are bearings 2 in a manner that prevents it from moving.

The flexible section 3, which, together with the flexible section 4 forms the wedge-shaped flexible element 1, is shown in FIG. 1 as an element purely guaranteeing tensile strength, for example, a traction rope or a traction belt. In the following, reference number 3 indicates a part that transmits solely traction forces and reference number 4 indicates a part that transmits traction and compressive forces.

When, as is shown in FIG. 1B, one moves the flexible sections 3, 4 on the side of the drive 15 relative to each other substantially along the longitudinal axis L of the wedge, the flexible element 1 according to the invention performs a curvature. The curvature takes place in the plane that stretches along the longitudinal axis of the flexible sections 3 and 4, and takes place in the direction in which forces, in FIG. 1B, the traction forces of the flexible section 3, act on the flexible section 4. The deflection of the flexible section 4 thereby increases, relative to the starting position shown in FIG. 1A, more the farther the flexible section 4 extends away from the drive side. In FIG. 1B, the relative movement is achieved by means of the drive 15 pulling on the traction-proof flexible section 3 (schematically shown in FIG. 1*b* by an arrow). In this way, traction forces at the wedge tip 8 of the flexible element 1 are transmitted by the flexible section 3 to the flexible section 4, shown in FIG. 1B as having a rod-like shape. The traction forces act on the tip of the flexible section 4 with a force component lateral to the longitudinal axis of the flexible section 4, as a result of which the wedge tip 8 of the flexible element 1 is moved in the bending plane and the flexible element 1 is transferred into the curvature shown in FIG. 1B.

The transition from FIG. 1A to FIG. 1B with relative movement of the flexible sections 3, 4 on the side of the drive is schematically summarized in FIG. 1D. The flexible sections 3, 4 shown as continuous lines thereby show the starting state of FIG. 1A. The flexible sections 3', 4', shown in dashed lines, show the curved state of FIG. 1B after relative movement by drive-side displacement of the traction-proof flexible section 3 on the drive side substantially along the longitudinal axis L of the wedge.

Alternatively, as shown in FIG. 1E, it is also possible to fix a traction-proof, i.e. tensile strength guaranteeing flexible section 3 in place in its bearing 2. In FIG. 1E, the traction-proof and compression-proof flexible section 4 is held along its longitudinal axis in the bearing 2 in a way that allows axial displacement, as is indicated by an arrow. In FIG. 1E, the tilt-preventing bearing 2 is a sleeve, whose internal cross-section substantially corresponds to the outer cross-section of the flexible section 4 that it holds. In this way, relative axial movement of sleeve 2 and flexible section 4 is guaranteed, without the flexible section 4 being able to tilt with respect to the bearing sleeve 2. The outward sliding of the flexible section 4 away from the drive side leads to traction forces being exerted on the wedge tip 8 across the traction-proof flexible section 3, which is fixed in place in its bearing, in a way similar to FIG. 1B, so that curvature of the flexible element 1 is achieved that is comparable to FIG. 13.

It is naturally also possible to combine the movements of FIGS. 1B and 1E and simultaneously to pull on the drive side at the traction-proof flexible section 3 and exert compressive forces in the direction away from the drive via the traction-proof flexible section 4 through axial displacement.

An alternative embodiment is shown in FIG. 1C. In this figure, the flexible element 1 substantially corresponds to the flexible element of FIG. 1*a*, but it additionally has a further traction-proof flexible section 3. The drive-side flexible sections 3, 4 are at a distance to each other and lie substantially on a line according to the embodiment of FIG. 1C. In this way, it is possible, if the traction-proof flexible sections 3 are moved on the drive side by the drive 15 substantially along the longitudinal axis L of the wedge relative with respect to the compression-proof flexible section 4, to achieve curvature of the flexible element on both sides. If, for example, one pulls on the left flexible section 3 shown in FIG. 1C, a bending corresponding to that in FIG. 1B is carried out, whereby the right flexible section 3 is also taken along and pulled axially away from the drive in its bearing. On the other hand, if one were to pull on the drive side at the right flexible section 3, which is not shown in FIG. 1C, the flexible element 1 would bend in the opposite direction, which would correspond to the mirror image of FIG. 1C. In this way, it is possible to bend the flexible element back and forth on both sides in one plane.

FIG. 2 shows an alternative embodiment of the drive device 30 according to the invention for a flexible impact blade 40.

Here, as also in all following figure descriptions, the same reference numbers are used for parts or elements that correspond to one in preceding figures.

The embodiment of FIG. 2 substantially corresponds to the embodiment of FIG. 1*a*, whereby the first flexible section 3 in FIG. 2 is, however, replaced by a second flexible section 4, which can be a traction and compression-proof flexible section. The two second flexible sections 4 shown span the flexible element 1, which is substantially formed in the shape of a wedge. Both of the second flexible sections 4 are held on the drive side in mounting elements 2 in a manner that prevents tilting.

One or also both of the second flexible sections 4 can optionally be moved relative to each other essentially along the longitudinal axis L of the wedge by the drive 15. Also shown is the wedge tip 8.

If, as is shown in FIG. 2, compressive forces are transmitted to the second flexible section 4 on the right side as provided in more detail in FIG. 4 by the drive 15, so that this is displaced outwards in the bearing 2 axially in the direction away from the drive, while the left flexible section 4 is fixed in place in its bearing 2, the flexible element 1 curves as shown in FIG. 2.

Were one, on the other hand, to transmit traction forces to the right flexible section 4 so that this flexible section were to be pulled axially on the drive side substantially in the direction of the drive, while the left flexible section is again firmly clamped, the curvature direction would reverse, i.e., the flexible tip 8 would be moved clockwise.

In this way, the embodiment shown in FIG. 2 can achieve bending of the flexible element 1 to two sides, with one flexible element 1 that has only two traction- and compression-proof flexible sections 4.

At the same time, one flexible section 4 can be fixed in place on the side of the drive, while the other flexible section is held axially in its bearing 2 in a way that allows it to be displaced, i.e., so that this can be displaced in and against the direction that substantially corresponds to the longitudinal axis L of the wedge. Alternatively, both flexible sections 4 can be held on the side of the drive in bearings 2 that prevent tilting.

In this case, one achieves the bending movement by applying a fraction or compressive load to the two flexible sections on the side of the drive, either alternating or at the same time, but then oppositely, i.e., a traction load is applied to the one flexible section 4 and a compressive load is applied to the other flexible section 4 at the same time. The simultaneous but opposing power transmission has the advantage that larger forces can be transmitted to the tip 8 of the flexible element 1.

One embodiment, in which both flexible sections 4 are held on the side of the drive in bearings 2 that prevent tilting but allow axial displacement, allows the flexible element 1 to be displaced collectively in the direction of the end facing away from the drive, i.e., so that it can be driven out without the flexible element 1 bending. By means of a parallel and simultaneous displacement of the flexible elements 4 of FIG. 2, it is consequently possible to displace the flexible element 1 relative to the drive or the base on which the drive device is arranged.

It is also possible to generate relative movement by means of a flexible section 4 fixed in place in a bearing 2. This can be achieved because there is a change in the length of the flexible section from its bearing up to the point at which the flexible section is coupled to another flexible section in a power-transmitting manner. For example, the length of a fraction- and compression-proof flexible section 4, which is built so that it can telescope, can be changed. The length of a traction-proof flexible section 3 can also be changed, for example, if one builds the flexible section to be contractile in the way of a muscle.

FIG. 3A is a top sectional view of the blade with guide sleeves and material distribution with chambers for reduced weight and shaped material for achieving certain mechanical, flow-dynamic, characteristics, as a possibility for pressure-variable filling with various media, as usable space.

FIGS. 3A-3C show an exemplary embodiment of a flexible impact blade 40 according to the invention, which flexible impact blade has a drive device according to the embodiment shown in FIG. 2. For the sake of clarity, the drive 15 is not shown in FIGS. 3A-3C.

FIG. 3A shows the flexible impact blade 40 in perspective. The flexible impact blade 40 has a blade span direction S, a cord direction B and a height H. The drive-side ends I of the flexible sections 4 are arranged in the area of the blade root. The flexible sections 4 of the flexible element 1 that extend away from the drive side I run substantially along the blade span direction S of the flexible impact blade 40.

The blade itself has a blade body 5 which is made of a plastic material. The blade body 5 in FIG. 3 consequently defines the flow profile of the flexible impact blade 40, whereby the moulded body represents the shaping element 5 of the flexible impact blade 40.

As is shown in FIGS. 3B and 3C, the blade body can, for example, be made from a shaped material 5*a*, such as, for example, foam or an elastomer, said shaped material 5*a* having hollow spaces 5*b*. The flexible sections 4 of the flexible element 1 are connected to the outer casing of the moulded body 5 in FIGS. 3A-3C in that sleeves 6 are provided in the area of the outer casing of the moulded body 5, into which the flexible sections 4 can be arranged.

The bending movement of the drive device 30, the curvature of the flexible sections 4 in the area of the wedge-shaped flexible element 1 from the flexible sections 4 on the side of the drive to the tip 8, can be transmitted to the elastic moulded body. In this way, a flexible impact can be realistically reproduced with means that are easy in terms of the design, in that the bending movement of the flexible element 1 activates flowing contour transitions of the shaping element 5 following the bending movement.

As is shown in FIG. 3C, the molded body 5 can have an elastic rear edge 22 on the downstream side, which optimizes the flow-dynamic behaviour and reduces swirling in the area of the rear edge on the downstream side.

In FIGS. 3A-3C the direction of flow is indicated with arrows. In the case of the molded body 5, which substantially has a cross-section formed in the shape of an ellipse, the upstream side edge is the obtuse, round end and the downstream side edge is the end with an acute angle.

Figure 4A:
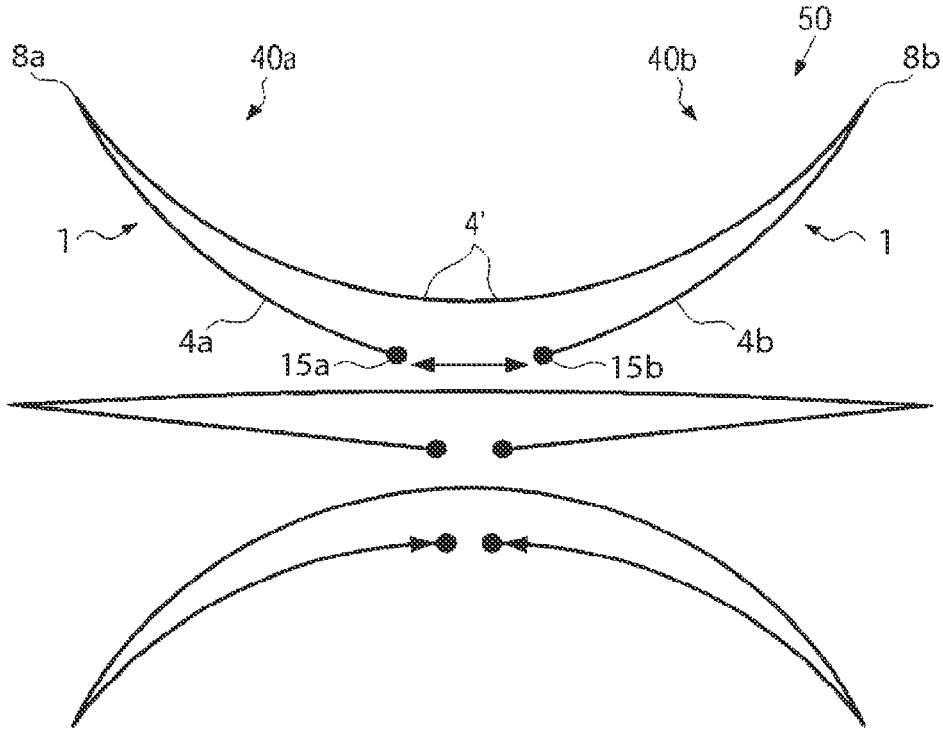
FIG. 4A shows a frontal view of the double wing in a first blade stroke phase
Figure 4B:
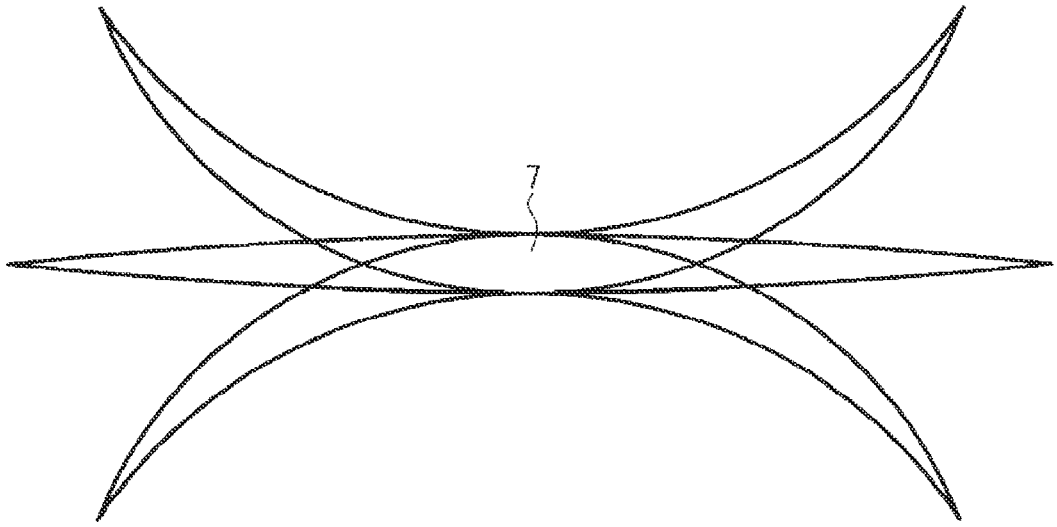
FIG. 4B shows a frontal view of the double wing in a second blade stroke phase which is also termed herein blade deflections.

FIG. 4A shows a frontal view of the double wing in a first blade stroke phase FIG. 4B shows a frontal view of the double wing in a second blade stroke phase which is also termed herein "a blade deflections.

FIGS. 4A and 4B show a special embodiment of a watercraft with moving flexible blades according to the invention, in which first and second flexible impact blade 40*a* and 40 according to the invention are used as the drive and/or control element.

The watercraft of FIGS. 4A and 4B comprise two flexible impact blades 40*a* and 40*b* which are arranged opposite each other and which are connected directly to each other at the blade roots. In the case of the watercraft shown herein, the flexible section 4' of the one flexible impact blade 40*a* is connected to the flexible section 4' of the other flexible impact blade 40*b* in a manner that transmits motion. In the embodiment shown in FIGS. 4A and 4B, a continuous flexible section 4' forms a flexible section of the one flexible impact blade 40*a* and the flexible impact blade 40*b*.

Each of the other flexible sections 4 of the flexible impact blade 40*a* or 40*b* are connected to a drive, a first drive 15*a* and a second drive 15*b* at its drive-side end in a manner that transmits motion. As a result of the drives, a drive component substantially directed in the direction of the longitudinal axis of the wedge-shaped flexible element 1 can be introduced into the flexible section by the drive during operation. This means that the ends of the flexible sections 4 that are on the side of the drive are connected to the respective drive 15*a* or 15*b* in such a way that they can be moved back and forth substantially in the direction of the longitudinal axis of the wedge. The movements of the two drives 15 are synchronized in such a way that both of the flexible sections 4 are pressed outwards, as seen in FIG. 4A or pulled inwards, as seen in FIG. 4B simultaneously. In this way, symmetrical bending of the two flexible elements 1 can be achieved and the watercraft 50 of FIGS. 4A and 4B can be operated as a flying wing.

Alternatively, the sections of the flexible sections 4 on the side of the drive can also be connected to a common drive, instead of each being coupled to its own drive.

Figure 5A:
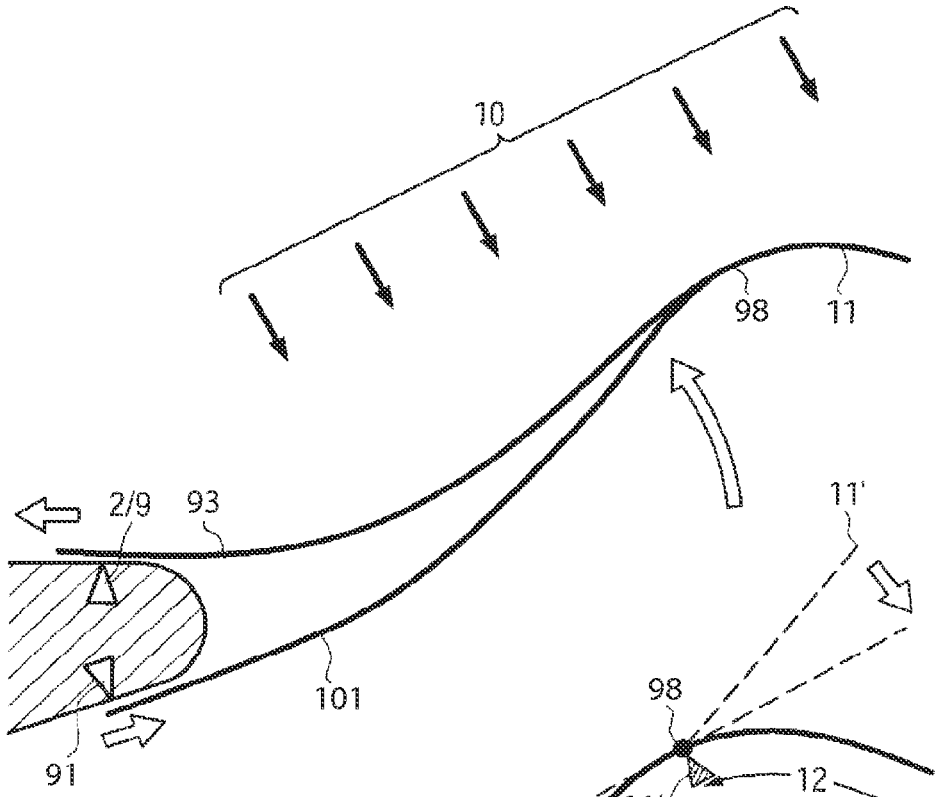
FIG. 5A shows an "anatomic" formation of a wave-shaped blade contour under the effect of external forces with the blade deflected upwards at the end of an up-stroke.

FIG. 5A shows an "anatomic" formation of a wave-shaped blade contour under the effect of external forces with the blade deflected upwards at the end of an up-stroke.

Figure 5B:
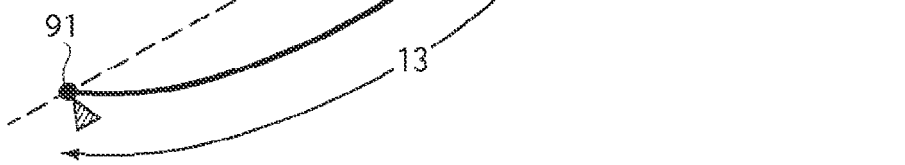
FIG. 5B shows a schematic formation of a wave-shaped blade contour under the effect of external forces with the blade deflected upwards. (e.g., at the end of an up-stroke)

FIG. 5B shows an schematic formation of a wave-shaped blade contour under the effect of external forces 10 with the blade deflected upwards (e.g., at the end of an up-stroke).

In FIGS. 5A and 5B, the arm area 13 is shown actively bent upwards with a longitudinal curvature according to the invention. The base is fixed in place between the at least one bearing 91 with the corresponding slideway 92.

The position of the connection point 98 of the two spars is defined by the relationship of the effective, i.e., free length of the compression bar 101 and the fraction belt 93, from the bearing 91, and this point acts against the forces 10 acting from outside as an additional anchor point or "virtual bearing". The lateral action of the external forces 10 can only amplify the curvature in the arm area 13. The soft flexible tip 11, on the other hand, has no second anchor point. The blade tip 11 is curved downwards by the effect of the lateral force 10 across the entire hand area 12, in comparison to the alignment in the relaxed state 11.

This results in a wave-shaped flexible beating movement, that can be implemented in a simple manner with the inventive force application at the distal end, axial guidance of the spar base and a simple additional measure, an elastically following hand, so that the flow behaviour is improved and there is an "organic" appearance to the motion kinetics.

FIGS. 6A-6D depict the flexible impact blade with a convex, preferably elliptical, body cross-section using a closed strap loop.

FIGS. 6A-6D show embodiments for various advantageous attachment possibilities of a flexible impact blade according to the invention to a convex-preferably elliptical—body cross-section using a closed strap loop.

FIG. 6A shows a one-sided attachment, i.e., only on one spar, and FIG. 6B shows attachment of both sides, i.e., on both spars. The advantage in this case is: a simple, robust, reliable attachment with tangential/axial, meaning optimal, application of force into the structure, good shape stability in all movement situations and load cases, extensive support—no thin axles—that is crash-proof, shock resistant and always form-fit.

The spars are run via the mounting point of the strap. At the end that extends and is lengthened in the proximal direction, a counter bearing is provided for support against the body contour, which ensures certain guidance when there are lateral forces acting on a blade.

FIG. 6C shows an advantageous wheel drive. By looping the loop 214 around an adjusting wheel 215, shown in the detail drawings as a single or double—for better traction—loop, the actuator is decoupled from large external forces in a simple way. The latter are taken up by the large loop, cannot press the wheel together, engage at that point tangentially (virtually) in one point, i.e., roughly in the same axis position, so the wheel cannot tilt, which consequently minimizes the axle load at the adjusting wheel. FIG. 6D shows equally advantageous alternatives with a punched tape with good lateral guidance, in which, e.g., a toothed wheel can engage.

FIGS. 6E and 6F show that the strap loop 214 can partially also be formed as a toothed belt, into which a matching toothed wheel 215 or a plurality of (preferably coupled—coupling not shown) adjusting wheels 215 act. The variant e) claims less constructed space, allows more room in the body and allows lower axle loads and loading of individual teeth or toothed belt sections due to the distribution of forces.

Figure 7A:
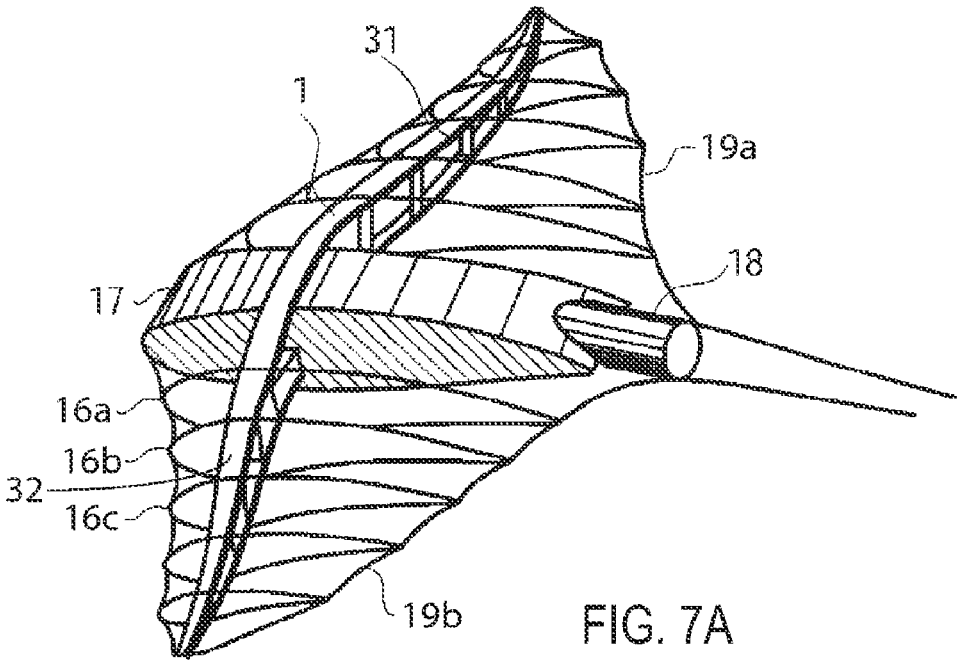
FIG. 7A shows an embodiment for flying wings with two flexible impact blades (type "eagle-ray") in a first view.
Figure 7B:
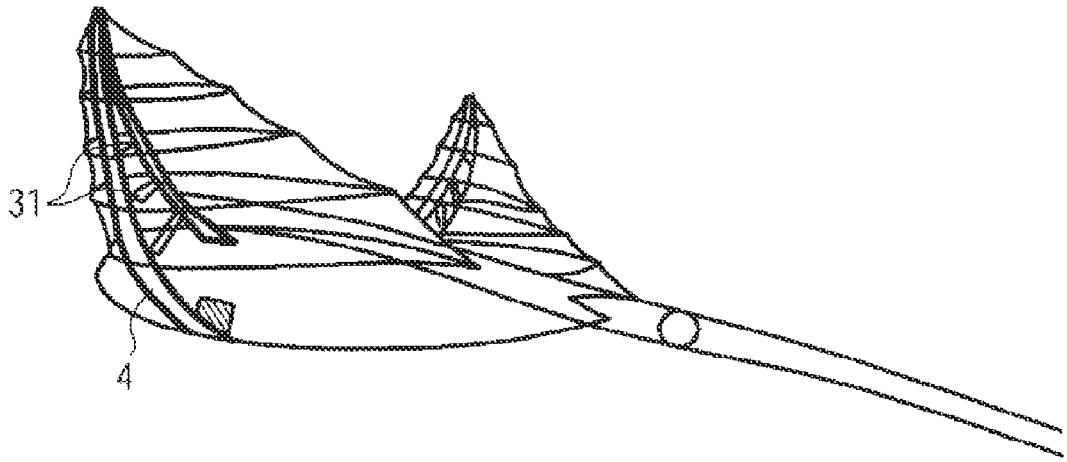
FIG. 7B shows an embodiment for flying winds with two flexible impact blades in a second view.

FIG. 7A shows an embodiment for flying wings with two flexible impact blades (type "eagle-ray") in a first view. A flexible element 1 is shown with multiple profile elements 16*a*, 16*b*, and 106*c*, a tail holder 18 and first and second wings with skin contour 19*a* and 19*b*. and two flexible frames 31 connected to 32. FIG. 7A shows the propulsion unit with the wings in the flat position and FIG. 7B shows the wings in the up position prior to causing a load as them move downwardly. A second flexible section is shown in FIG. 7B. FIG. 7B shows an embodiment for flying winds with two flexible impact blades in a second view.

Figure 8A:
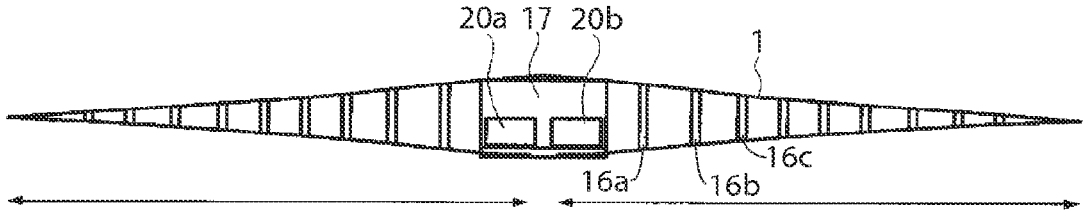

FIG. 8A is a frontal view of another embodiment with an actuator and drive wheels and a movable tail wing drawn in. In these figures the flexible element 1 is shown with an elliptical body cross section 17 with multiple profile elements 16*a*, 16*b*, 16*d* and two actuators 20*a*, 20*b*.

Figure 8B:
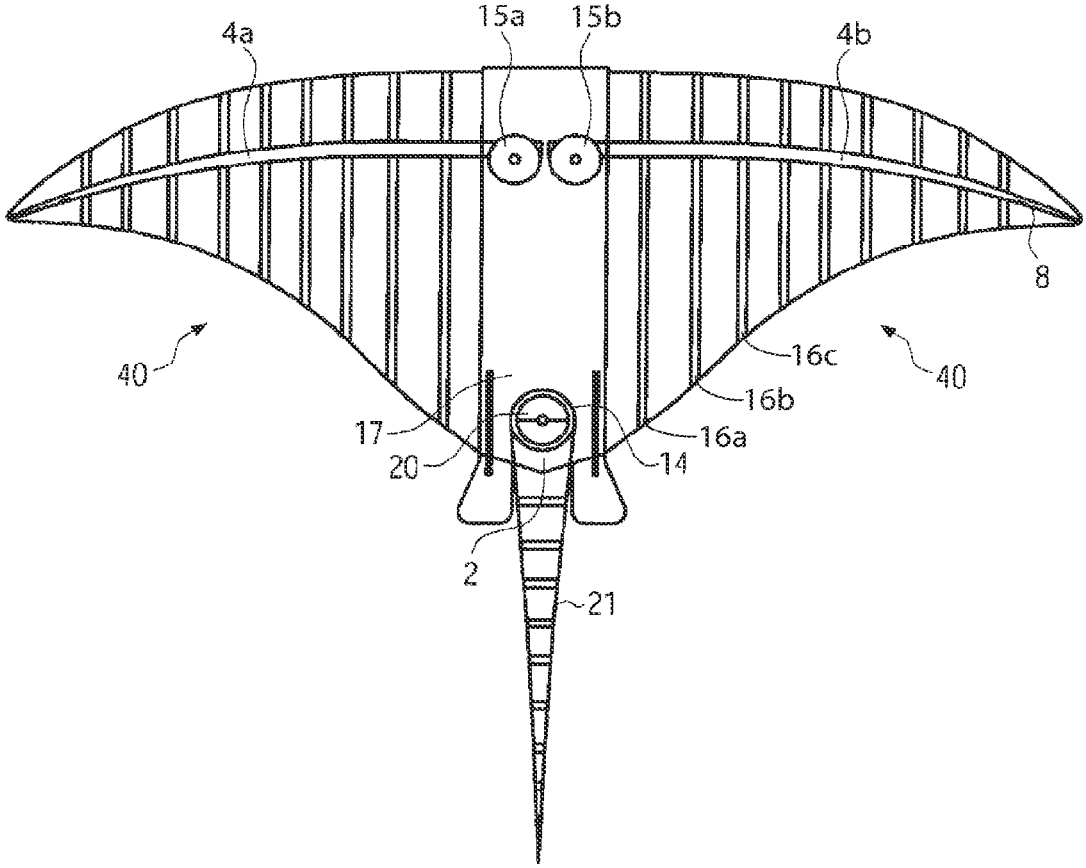

FIG. 8B is a dorsal view of another embodiment with actuator and drive wheels and a movable tail wing drawn in. A second flexible section first portion 4*a* and a second flexible section second portion 4*b*. A first drive 15*a* and a second drive 15*b* are shown. Profile elements 16*a*, 16*b*, 16*c* are shown as well as many more. The tail holder 8 is shown. An elliptical body cross section 17 is featured. The flexible impact blade 40 is depicted overall.

The Figure shows mounting element 2, the tail bendable surface element 21, and actuator 20.

FIG. 9A shows a front view of a wing with two mounting elements 2*a* and 2*b* secured to an elliptical body cross section, covered with a skin contour 19 and two blade tips, one of which is labelled as 11.

FIG. 9B shows a detail of a wing with the same elements as FIG. 9A, but with two mounting elements 2*a* and 2*b*, and tail bendable surface element 21.

FIG. 9C shows a bottom view of the wings attached to the elliptical body with the same elements as FIGS. 9A and 9B however with two skin contours 19*a* and 19*b*. A power transmission element 314*a* and 314*b* and a second flexible section 4 are depicted. Multiple elastic rear edges 22*a*, 22*b*, 22*c*, and 22*d* are also shown.

FIG. 9D shows an end of the wing attached to the body with the wing tip 11, the skin contour 19 and elastic rear edge 22*a*.

FIG. 9E shows another embodiment of the winged body with and three bendable surface elements in a horizontal arrangement, with the same elements as noted in FIGS. 9A-9D.

Figure 10:
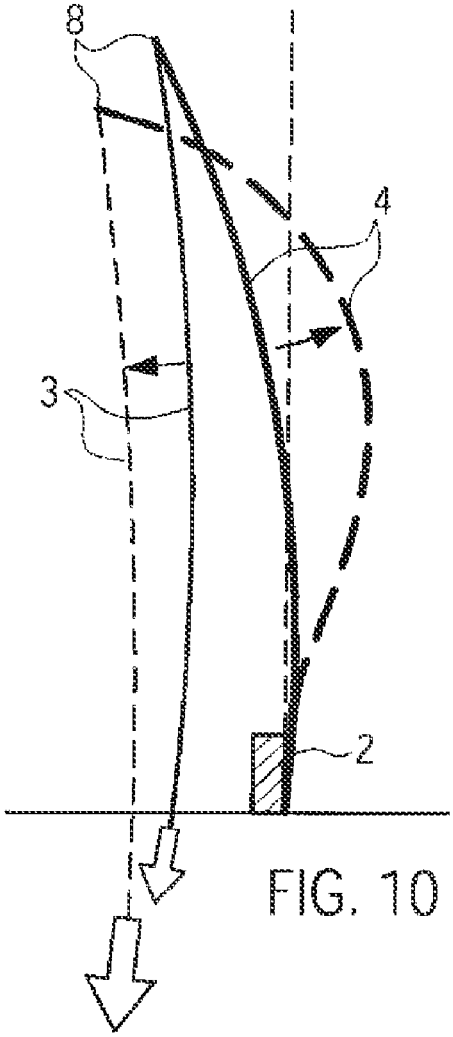
FIG. 10 is a schematic illustration of the motion tendencies that diverge in the cross-direction with the basic principle.

FIG. 10 shows a schematic illustration of the motion tendencies that diverge in the cross-direction with the basic principle.

Force is applied to an outer end of the wedge tip 8 of the blade spar and the buckling of the second flexible section 4 and a first flexible section 4, shown here as a traction belt 3, which has shifted from its original position, which can result from an overload if there are no profile ribs. A mounting element 2 is shown.

Figure 11:
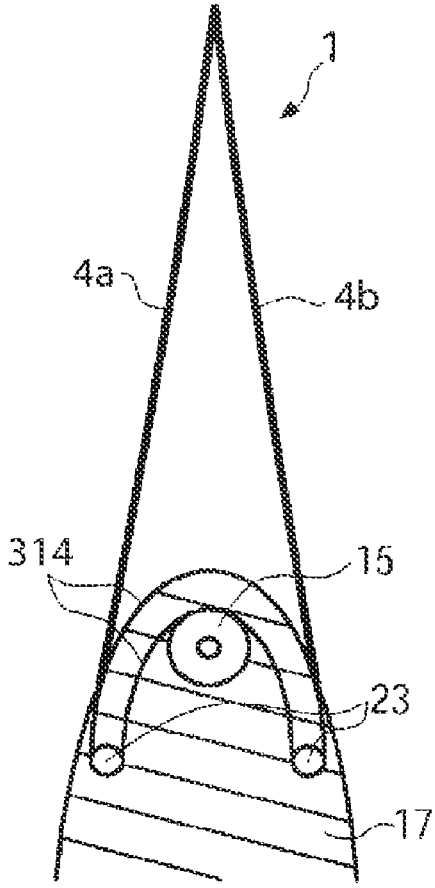
FIG. 11 shows a variant of a blade suspension using a traction loop as the power transmission element.

FIG. 11 shows the flexible element with a with a top flexible section 4*a* and a bottom flexible section 4*b*. A variant of a blade suspension is shown using a traction loop as the power transmission element 314. The drive 15 which can be a driving gear tightens the power transmission element 314 which can be a loop, over the counter bearings 23 and lies within the flexible element or support composite. The elliptical body cross section is identified as element 17.

Figure 12:
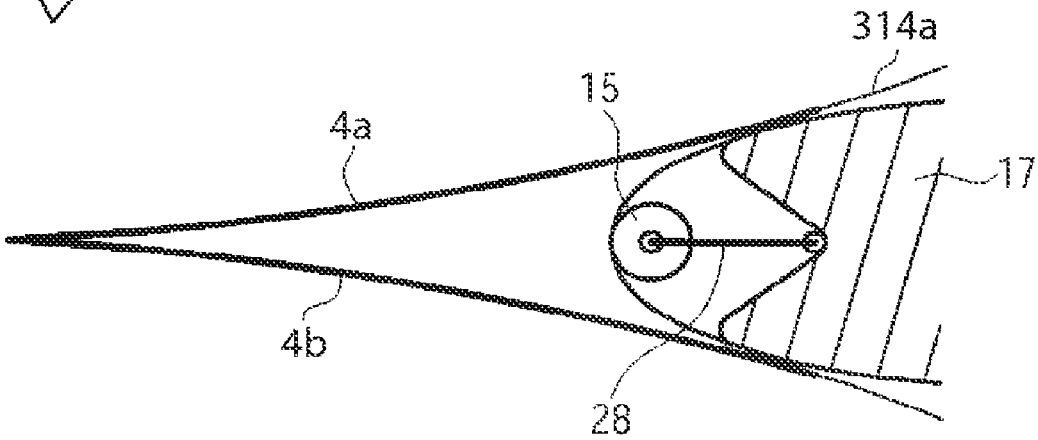
FIG. 12 further shows a variant of a blade suspension using a traction loop.

FIG. 12 shows a variant of the elliptical body 17 a blade suspension using a traction loop as the power transmission element 314, in which the driving 15 is held by a bracket which can be actively or passively pivoted around a proximal supporting point. A bracket 28 is shown.

Figure 13:
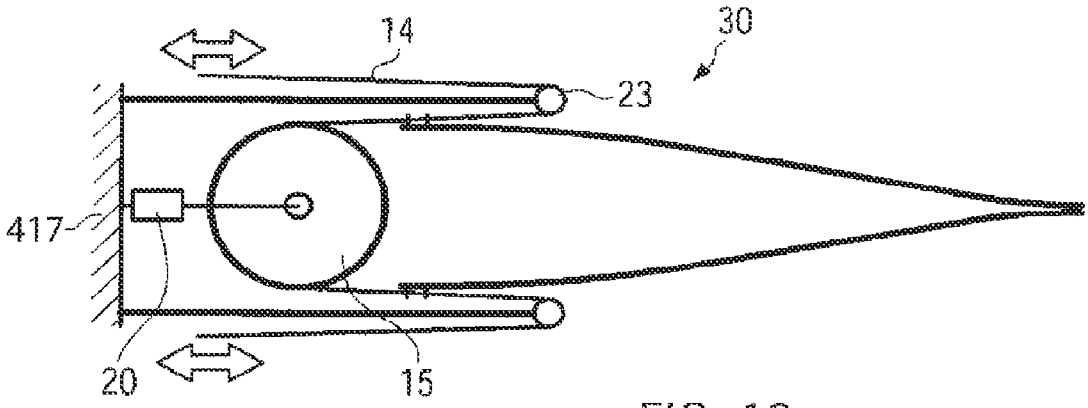
FIG. 13 further shows a variant of a blade suspension by means of a traction loop.
Figure 14:
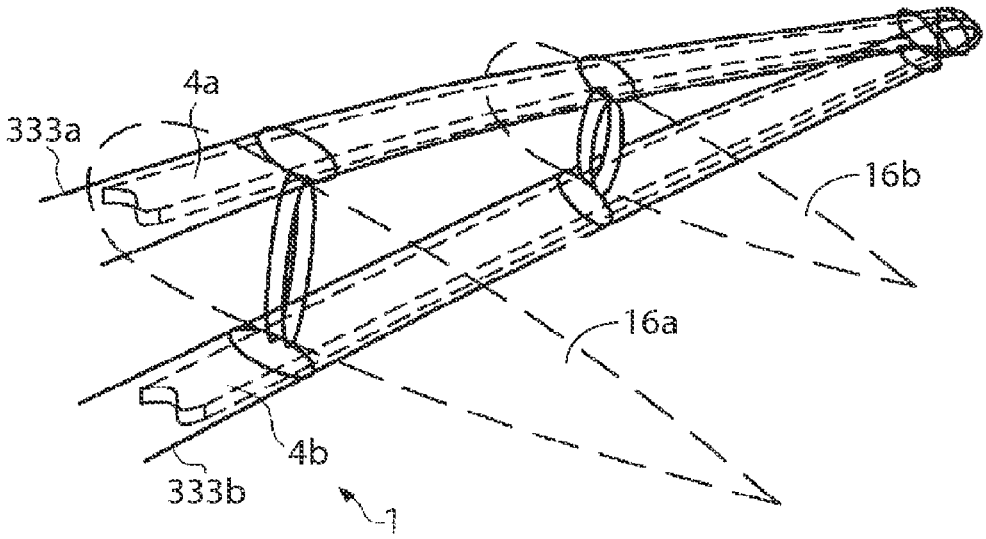
FIG. 14 depicts an embodiment in which the flexible element is enveloped by a traction-resistant structure.

FIG. 13 shows a variant of a blade suspension by means of a closed strap loop 14, in which the drive device 30 is designed to be driven out laterally, i.e., it can be displaced in its blade span direction with respect to a body 417 and also driven back in again. In this process, the drive 15 tightens the closed strap loop 14 over the counter bearing 23 and is displaced via the actuator 20, together with the other elements of the drive device 30, whereby at the same time, a length compensation of the straps 14 that is not shown here is performed;

FIG. 14 depicts an embodiment in which the flexible element 1 with the top and bottom flexible sections 4*a* and 4*b* is enveloped by a traction-resistant structure 333*a* and 333*b*. Also shown are profile elements 16*a* and 16*b*.

Figure 15:
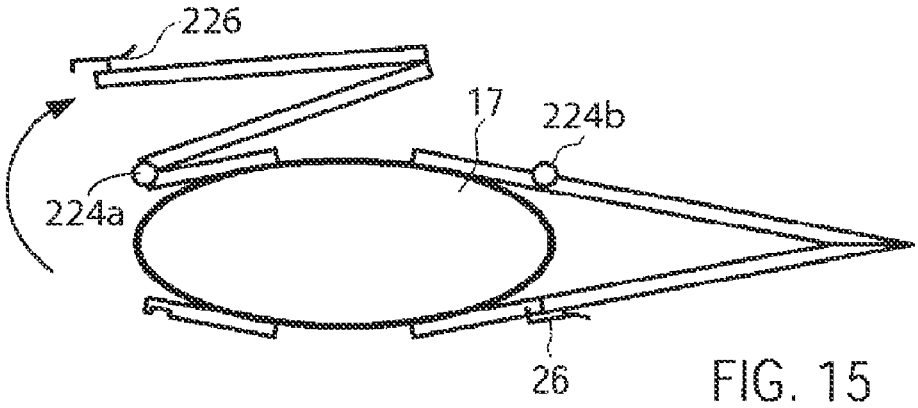
FIG. 15 shows an embodiment for a folding mechanism with pivot points in the spar.

FIG. 15 shows an embodiment for a folding mechanism 225 with pivot points in the spar 224*a* (in the folded position) and 224*b* in the unfolded position, around which the outer blade section can be folded across the blade surface, and connection elements that allow locking in the work position. The elliptical body 17 is also identified.

Figure 16:
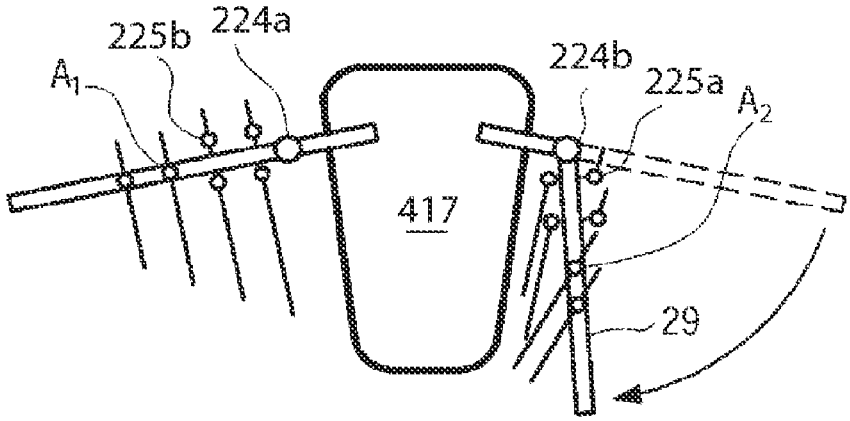
FIG. 16 shows an embodiment of a blade structure that can be folded together, and which also permits a change in the wing sweep.

FIG. 16 shows an embodiment of a blade structure that can be folded together, and which also permits a change in the wing sweep with first pivot points 224*a* and second pivot points 225*a* communicating with a support element 29 which can be a composite. Element A1 is a third pivot point and element A2 is a fourth pivot point. The body is shown with other than an elliptical cross section as element 417.

Figure 17:
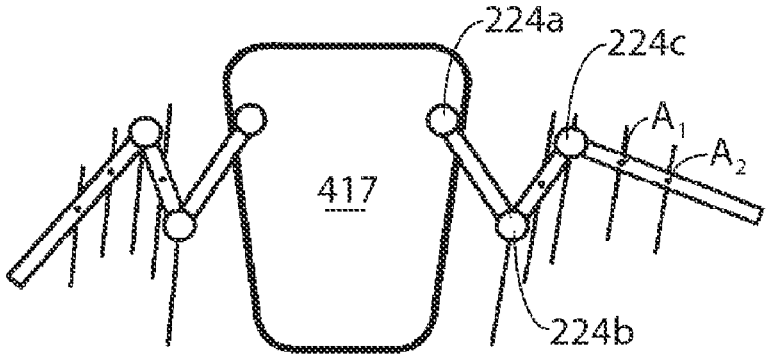
FIG. 17 depicts an example for a flexible impact blade with a bird wing-like arm skeleton.

FIG. 17 depicts an example for a flexible impact blade with a bird wing-like arm skeleton which has joints and which embodies a folding mechanism, with which a change in the length of the wing in the blade span direction can be achieved with simultaneous variation of the wing surface or with which the wing can also be folded together.

The body 417 is shown having a rounded slightly triangular shape or possibly trapezoid. Three pivot points 224*a*, 224*b* and 224*c* are shown. Additional pivot points A1 and A2 are shown.

Figure 18:
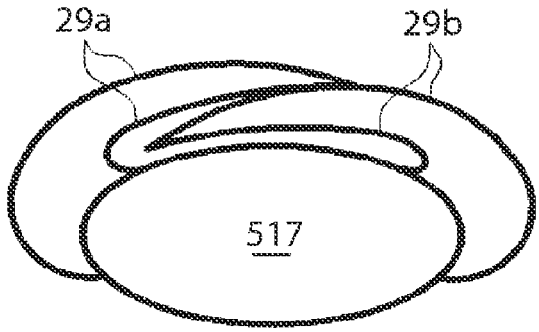
FIG. 18 illustrates that the flexible blade can be rolled up.

FIG. 18 illustrates that the flexible blade that can be rolled up with the first and second support elements 29*a* and 29*b* being folded over a circular body 517.

Figure 19:
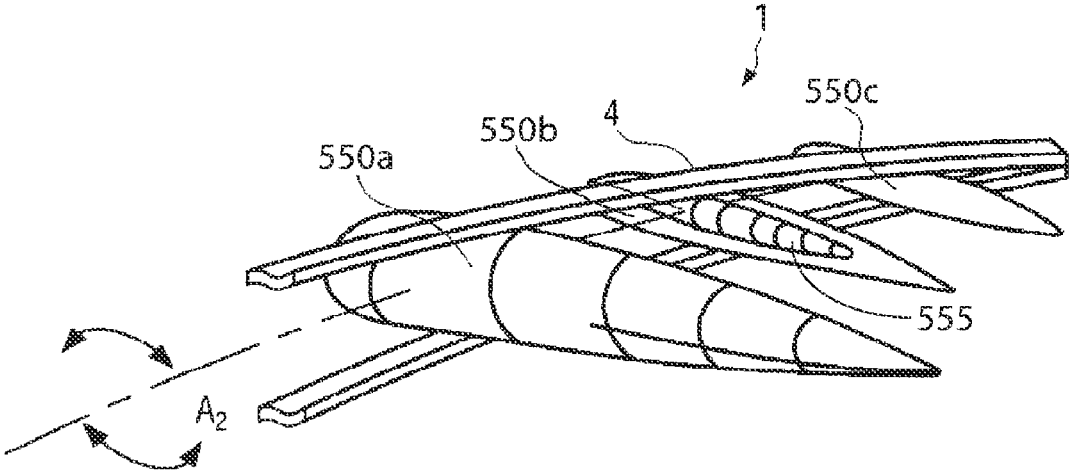
FIG. 19 depicts a flexible element torqued around the axis, with profile element.

FIG. 19 depicts a flexible element torqued around an axis, with profile elements in various embodiments. This figure depicts hollow bodies 550*a,b* and *c* which can optionally be filled with various media 555 to vary the pressure, additional stiffening ribs and shaped material. Three profile elements are within the second flexible section 4.

Figure 20:
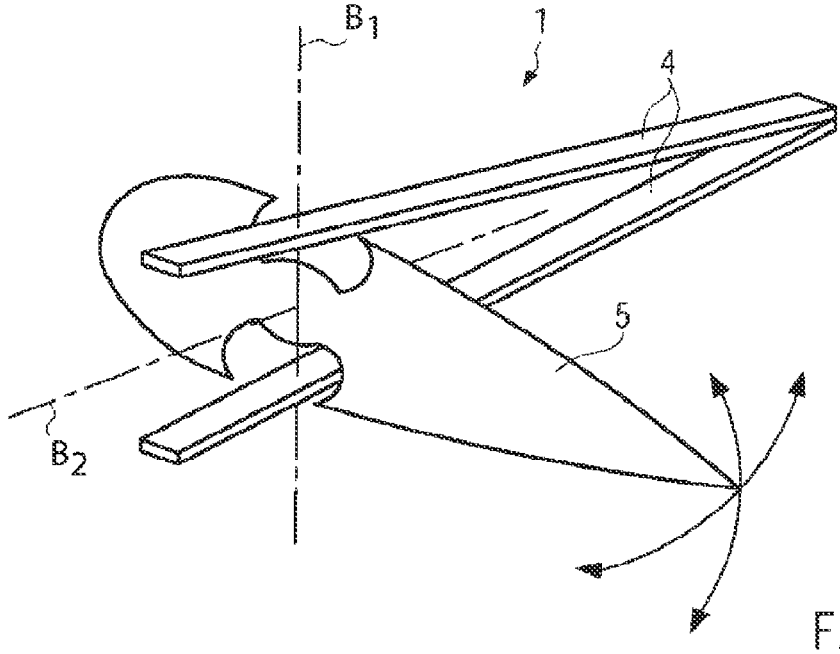
FIG. 20 illustrates a sketch of a flexible element with profile elements.
Figure 21:
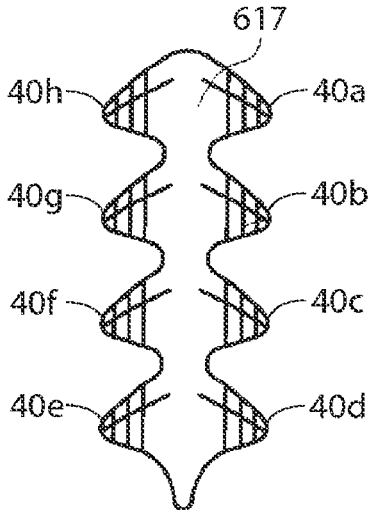
FIG. 21 shows a serial arrangement of a plurality of blade pairs on a body.

FIG. 20 illustrates a sketch of a flexible element 4 with profile element 5 which are supported in the axis B1 and B2 with respect to the support composite in a manner that allows rotation, and so facilitates or allows a 3D deformation of the blade;

FIG. 21 shows a serial arrangement of a plurality of blade pairs on a body 617 which together can execute an undulating movement, at the same time each can use the slipstream field of the precursor pair in an energy-saving manner. In this FIG. 8 flexible impact blades 40*a*, 40*b*, 40*c*, 40*d*, 40*e*, 40*f*, 40*g*, and 40*h* are shown.

Figure 22:
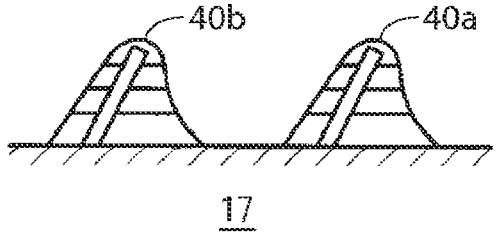
FIG. 22 shows a flexible impact blade attached on one side.
Figure 23:
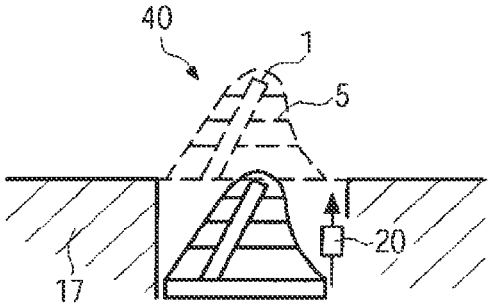
FIG. 23 shows a blade element, which can be driven in and out by means of actuators relative to another structural unit or structure.

FIG. 22 shows a flexible impact blade 40*a* and 40*b* attached on one side of a body 17. The blades can, drive or stabilize an object or move (propel) or conduct a medium, or which also can be moved by the flow, such as for energy generation;

FIG. 23 shows a flexible impact blade 40, which can be driven in and out of the body 17. The flexible element 1 is shown in the blade body 5 in the up position in ghost lines and in the down position using an actuator 20. Various actuators are used to move it in or out relative to another structural unit or structure, for example, for use on a ship as a stabilizer.

Figure 24:
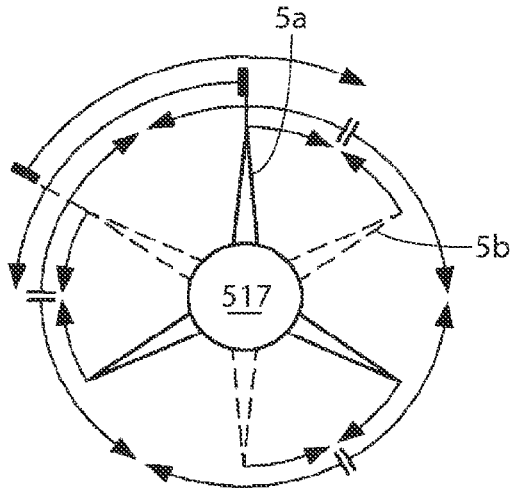
FIG. 24 shows an example for a star-shaped arrangement of a plurality of blades around a body.

FIG. 24 shows an example for a star-shaped arrangement of a plurality of blades 5 (2×3) around a body circular 517, which beat back and forth or which are arranged on hubs in two levels, stacked one behind the other, and which rotate in opposite directions as rotors.

Figure 25:
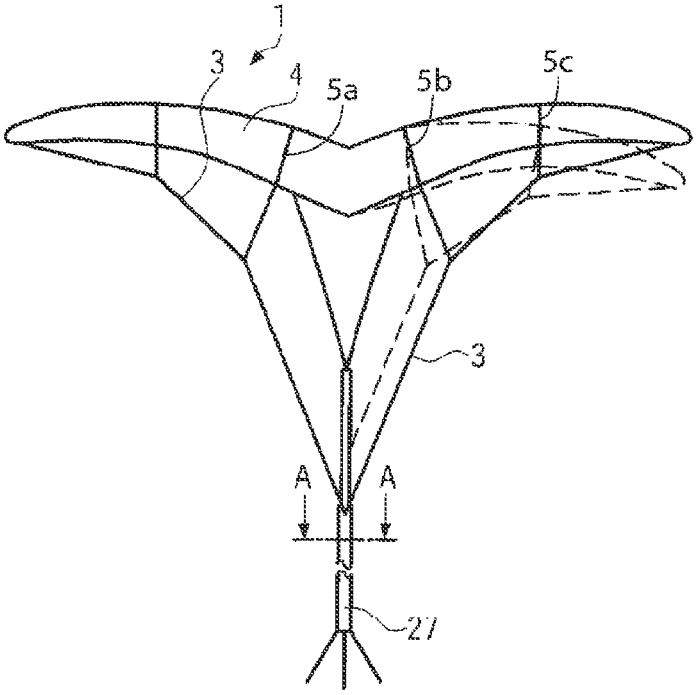
FIG. 25 shows an example for a double-blade structure with a flow against one side.

FIG. 25 shows an example for a double-blade structure with a flow against one side: kite, current anchor, with the first flexible section 3, a second flexible section 4, and blade bodies 5*a*, 5*b*, 5*c* and the flexible section that acts on the traction side, profile ribs and a cord sheath 27.

In a further advantageous embodiment, which is shown schematically in FIG. 25 the flexible element 1 can also be formed such that there is a flow against only one side, i.e., it is brought into a blade angle or angle of attack relative to a flowing medium. In this case, the flexible section 4 with the skin contour 19 can be on the compression-receiving side of the structure and the first flexible section 3 can be on the traction-receiving side. In the case of a kite-like structure, a part of the kite would be the second flexible section 4 and the balance (the holding network) would be the first flexible section 3. This first flexible section 3 would then be guided up to the middle area from the point of attack 8 and/or the blade rear edge via structural elements and would there, where appropriate, run into the sheath 27 mentioned in the following. Such a structure could be held by a back pull (a rope) and actuated by additional ropes. In the context of a stunt kite, a one-sided pull causes one side to rise and the other to fall, and consequently leads to a turn. In order to change the lift/buoyancy, the connecting element can also be used for adjusting the rear edge. The traction elements can run diagonally over the blade in an advantageous embodiment, so that, when there is a change in length, a twisting of the blade is additionally brought about. As a result of the new structure, the control cords are positioned closely together and could, in order to minimize the resistance, be partially run together in profile-like cord sheaths 27 and separated again at the lower end for the control function. This would also lead to better control, because the changed flow into the cords, which depends on the different tension, would consequently be reduced.

Figure 26:
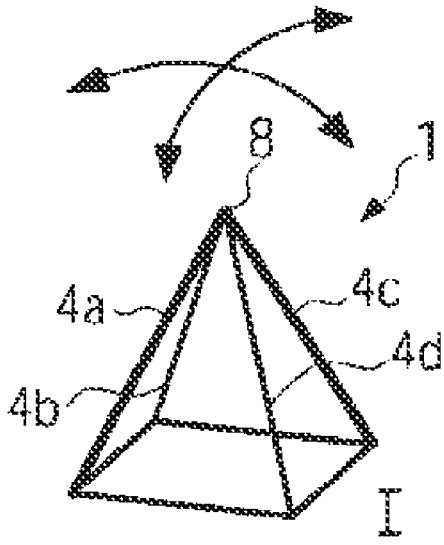
FIG. 26 shows a further embodiment of a flexible element.

FIG. 26 shows flexible element 1 is substantially developed in the form of a pyramid-shaped wedge with a rectangular, in this case, square, base. For this purpose, the flexible element 1 has four flexible sections 4*a* to 4*d*, which are at a distance to one another on the side of the drive, whose distance from one another is reduced in the direction away from the drive, not shown in this Figure.

The flexible sections 4*a* to 4*d* represent the edges of the pyramid-shaped wedge, which extends from the pyramid base on the drive side up to the pyramid tip 8 in the area of the end of the flexible element 1, the pyramid tip 8, that faces away from the drive.

The drive-side ends of the flexible sections 4*a* to 4*d* can be loaded with a compression or traction by a drive 15, also not shown in this Figure. The advantage of this embodiment is that two flexible sections each form a flexible element 1, as is shown in FIG. 2. I.e., by means of corresponding relative movement of the flexible sections on the drive side, for example, the flexible sections 4*a* and 4*c*, the flexible element 1 can be curved in the plane which is spanned by the longitudinal axes of the flexible sections 4*a* and 4*c*. Due to the fact that additional flexible sections 4*b* and 4*d* are provided, which can transmit a force to the tip 8 of the flexible element 1, which force has a compression component perpendicular to this plane, it is also possible to curve the flexible element 1 out of the bending plane defined by the flexible sections 4*a* and 4*c* with the flexible element 1 of the embodiment shown in FIG. 26. In this way, the flexible element of FIG. 26 can, in principle, be curved in all bend planes, which are defined by the longitudinal axes of two of the flexible sections 4*a* to 4*d* by means of displacing the corresponding flexible sections relative to one another on the drive side. The tip 8 of the flexible element 1 can consequently be moved back and forth in a plurality of directions and can circle or describe a concavely curved surface collectively by means of mixed motions.

Driving the drive-side sections of the flexible sections 4*a* to 4*d* preferably takes place in such a way that the respective diagonally opposite sections 4*a* and 4*c* or 4*b* and 4*d* are activated as V-supports or are coupled by actuator. In this way, one achieves the largest possible base spacing of the flexible sections spaced apart from one another on the side of the drive, as a result of which the largest possible force can be applied, because the wedge tip 8 of the respective V-support forms the largest possible angle.

Even if this is not shown in FIG. 26, it is not necessary to form the individual flexible sections 4*a* to 4*d* with the same length. It is also not necessary for the base of the pyramid defined by the drive-side sections of the flexible sections 4*a* to 4*d* to be square, and it can be any other rectangular form. In principle, it is possible to use any number of flexible sections and to combine them into a pyramid-shaped wedge.

Furthermore, it is also possible that in FIG. 26 two flexible sections arranged diagonally opposite each other, for example, the sections 4*a* and 4*c* or the sections 4*b* and 4*d*, are formed as solely traction-proof flexible sections, for example, traction ropes. The possible bending of the flexible support 1 is not interfered with by this.

Figure 27:
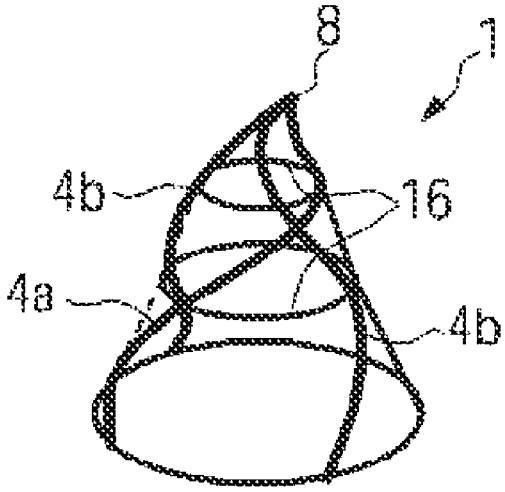
FIG. 27 shows another embodiment of a flexible element.

FIG. 27 shows a further embodiment of a flexible element, with which bending and torsional motions can be generated.

FIG. 27 further shows the flexible element 1, whose basic principle corresponds to that of the embodiment of FIG. 26. Unlike the one in FIG. 26, however, the flexible element 1 of FIG. 27 has three flexible sections 4*a* to 4*c* that are at a distance to one another on the side of the drive and that are formed as compression bars. With this configuration of three flexible sections 4*a* to 4*c*, which substantially form a tetrahedron-shaped wedge, it is also possible to move the tip 8 of the flexible element 1 like the tip 8 of the flexible element 1 of the embodiment from FIG. 26.

Furthermore, the flexible element 1 of FIG. 27 differs from the flexible element of FIG. 26 in that the flexible sections substantially extend in a screw shape from the drive-side end of the flexible element to the end of the flexible element facing away from the drive. As a result of this screw-shaped development, it is possible to achieve combined bending and torsional movements. Naturally it is also possible to develop only one or only selected flexible sections of a flexible element in a screw shape, in order to achieve selective movement patterns from one bending movement overlaid by a torsional movement.

A further possible development is to arrange any number of drive devices in any physical alignment with respect to one another. A plurality of drive devices can, for example, be arranged in a plane around a common middle axis, as a result of which, e.g., a bell-shaped motion would be possible. A plurality of drive devices could also be arranged radially in space around a common centre point. In this way it would be possible to imitate the shape of a sea urchin.

The drive device or the blade can be rigidly held on a base element, e.g., a body. It is also possible, however, to hold the drive device in such a manner that it can move, for example, by attachment to a base element that can rotate, pivot, fold or otherwise move. In this way, the drive device can be adjusted relative to the body to which it is attached, independently of its operation.

In addition, the pyramid-shaped wedge can be formed from any number of flexible sections.

Legend of the reference numbers with synonyms include:

- 1 Support element, spar, flexible element, flexible bar, compression bar;
- 2 Support, bearing, guide, slide bearing;
- 3 Traction-proof connection element, traction rope, traction belt, tensioning element;
- 4 Connection element, which is traction- and pressure-proof, support element, spar, flexible element, flexible bar, compression bar;
- 5 Profile body, blade body;
- 5*a* Shaped material (elastomer, foam, etc.);
- 5*b* Chambers, hollow spaces, usable space;
- 6 Sleeve, casing, bushing, slide bearing, guide, etc.;
- 7 Free area, design room;
- 8 Connection point, working point, power transmission point, tip;
- 9 Bearing;
- 9' Virtual bearing;
- 10 External application of a force;
- 11 Soft/flexible/elastic/bendable seat, elastic winglet;
- 11'=11 in relaxed state;
- 12 "Hand area";
- 13 "Arm area";
- 14 Strap, loop, power transmission element, drive component;
- 15 Driving gear, adjusting wheel, where applicable, toothed wheel, drive;
- 16 Profile ribs, profile clips, form stabilizers;
- 17 Body, body segment, support unit;
- 18 Tail support, where appropriate, nozzle for thrust vector control;
- 19 Elastic contour band or skin contour, form stabilizer;
- 20 Actuator;
- 21 Tail blade, tail;
- 22 Elastic rear edge;
- 23 Counter bearing;
- 24 Axis in spar;
- 25 Axis in profile;
- 26 Spar connection element;

27 Cord sheath;
28 Bracket;
29 Support composite or support element with two spars;
30 Drive device;
40, 40*a*, 40*b* Flexible impact blades;
50 Water- or aircraft;
A1 Axis in plumb direction onto the blade surface;
A2 Axis in blade span direction/expansion direction of the support composite;
I Drive-side end of the flexible element;
II End of the flexible element facing away from the drive;
L Longitudinal axis of the wedge-shaped flexible element; and
d Distance between flexible sections, and with these legends.

While these embodiments have been described with emphasis on the embodiments, it should be understood that within the scope of the appended claims, the embodiments might be practiced other than as specifically described herein.

What is claimed is:

1. A drive device configured on a side such that the drive device can be connected to a drive, and which has a flexible element that is configured substantially in the shape of a wedge, having at least two flexible sections extending away from the drive and that are at a distance to each other on the side of the drive, the distance from each other of which is reduced in the direction away from the drive and which are coupled in the region of the end of the flexible element facing away from the drive in a power transmitting manner, wherein the flexible sections on the side of the drive are kept movable relative to each other substantially along the longitudinal axis of the wedge and that the flexible element is configured on the side of the drive such that it may be transferred to a different curvature pointing in the direction of the thickness of a flexible impact blade as a function of the relative position of the flexible sections.

2. The drive device according to claim 1, wherein a section of at least one flexible section is held on the drive-side end in a bearing in a way that prevents tilting.

3. The drive device according to claim 1, wherein the flexible element is substantially developed in the form of a pyramid-shaped wedge and has at least three flexible sections separated from one another on the drive side, whose distance from one another is reduced in the direction away from the drive.

4. The drive device according to claim 1, wherein the end of the flexible element that faces away from the drive continues in the direction away from the drive as a flexible extension.

5. The drive device according to claim 1, wherein at least one flexible section extends at least in sections substantially in the form of a screw away from the drive-side end of the flexible element to the end of the flexible element facing away from the drive.

6. The drive device according to claim 1, wherein a drive is present that can be attached to the drive-side end of at least one flexible section in such a manner as to transmit motion, by means of which during operation a drive component aimed at the end of the flexible element facing away from the drive can be introduced into the flexible section.

7. The drive device according to claim 1, wherein the drive has at least one reversible power transmission element, which connects at least two flexible sections to one another on the drive side.

8. The drive device according to claim 1, wherein at least one form stabilizer is provided, which limits the maximum distance between two flexible sections on at least one point of the flexible element.

9. The drive device according to claim 1, wherein connection elements are provided, each of which keeps two points of the flexible sections the same distance apart regardless of the deformation of the flexible element.

10. The drive device according to claim 1, wherein said drive device is adapted for use with a flexible impact blade.

11. A flexible impact blade comprising at least one drive device for changing an outer contour of the flexible impact blade, which drive device is configured on a side such that the drive device can be connected to a drive, and which has a flexible element that is configured substantially in the shape of a wedge, having at least two flexible sections extending away from the drive and that are at a distance to each other on the side of the drive, the distance from each other of which is reduced in the direction away from the drive and which are coupled in the region of the end of the flexible element facing away from the drive in a power transmitting manner, wherein the flexible sections on the side of the drive are kept movable relative to each other substantially along the longitudinal axis of the wedge and that the flexible element is configured on the side of the drive such that it may be transferred to a different curvature pointing in the direction of the thickness of the flexible impact blade as a function of the relative position of the flexible sections, and wherein the drive-side ends of the flexible sections are arranged in the area of a blade root.

12. The flexible impact blade according to claim 11, wherein the flexible impact blade has an elastic outer casing in which the at least one flexible element, as well as at least one shaping element connected to the flexible element and defining a flow profile of the flexible impact blade, are arranged.

13. The flexible impact blade according to claim 11, wherein a multiplicity of profile bodies at a distance from one another are provided which are substantially arranged along a flexible section.

14. The flexible impact blade according to claim 13, wherein the profile bodies simultaneously represent form stabilizers of the drive device.

15. A watercraft with a drive element, control element or combination thereof, wherein the drive element, control element or combination thereof is a flexible impact blade comprising at least one drive device for changing an outer contour of the flexible impact blade, which drive device is configured on a side such that the drive device can be connected to a drive, and which has a flexible element that is configured substantially in the shape of a wedge, having at least two flexible sections extending away from the drive and that are at a distance to each other on the side of the drive, the distance from each other of which is reduced in the direction away from the drive and which are coupled in the region of the end of the flexible element facing away from the drive in a power transmitting manner, wherein the flexible sections on the side of the drive are kept movable relative to each other substantially along the longitudinal axis of the wedge and that the flexible element is configured on the side of the drive such that it may be transferred to a different curvature pointing in the direction of the thickness of the flexible impact blade as a function of the relative position of the flexible sections, and wherein the drive-side ends of the flexible sections are arranged in the area of a blade root.

16. The watercraft according to claim 15, wherein at least two flexible impact blades are arranged opposite one another or on a body, each flexible impact blade comprising at least one drive device for changing the outer contour of the flexible impact blade, which drive device is configured on a side such that the drive device can be connected to a drive, and which has a flexible element that is configured substantially in the shape of a wedge, having at least two flexible sections extending away from the drive and that are at a distance to each other on the side of the drive, the distance from each other of which is reduced in the direction away from the drive and which are coupled in the region of the end of the flexible element facing away from the drive in a power transmitting manner, wherein the flexible sections on the side of the drive are kept movable relative to each other substantially along the longitudinal axis of the wedge and that the flexible element is configured on the side of the drive such that it may be transferred to a different curvature pointing in the direction of the thickness of the flexible impact blade as a function of the relative position of the flexible sections, and wherein the drive-side ends of the flexible sections are arranged in the area of the blade root.

17. The watercraft according to claim 16, wherein at least one flexible section of the one flexible impact blade is connected to the flexible section of the other flexible impact blade in a manner that transmits motion.

18. The watercraft according to claim 16, wherein at least one flexible section of the one flexible impact blade and at least one flexible section of the other flexible impact blade are connected to the same drive.

* * * * *